US008284102B2

(12) United States Patent
Hayes et al.

(10) Patent No.: US 8,284,102 B2
(45) Date of Patent: Oct. 9, 2012

(54) DISPLACED FEED PARALLEL PLATE ANTENNA

(75) Inventors: David Hayes, Winchester (GB); Richard Brooke Keeton, Beaulieu (GB)

(73) Assignee: Plasma Antennas Limited, Harwell, Oxfordshire (GB)

( * ) Notice: Subject to any disclaimer, the term of this patent is extended or adjusted under 35 U.S.C. 154(b) by 247 days.

(21) Appl. No.: 12/448,951

(22) PCT Filed: Jan. 15, 2008

(86) PCT No.: PCT/GB2008/000120

§ 371 (c)(1),
(2), (4) Date: Jul. 16, 2009

(87) PCT Pub. No.: WO2008/087388

PCT Pub. Date: Jul. 24, 2008

(65) Prior Publication Data

US 2010/0060521 A1 Mar. 11, 2010

(30) Foreign Application Priority Data

Jan. 19, 2007 (GB) ..... 0701087.9

(51) Int. Cl.
*H01Q 3/46* (2006.01)
*H01Q 19/12* (2006.01)
*H01Q 19/06* (2006.01)

(52) U.S. Cl. ..... 342/374; 342/372; 342/373; 343/753; 343/754; 343/755; 343/781 R

(58) Field of Classification Search ..... 342/368, 342/371, 372–376; 343/753–755, 781 R, 343/834–836

See application file for complete search history.

(56) References Cited

U.S. PATENT DOCUMENTS

| | | | |
|---|---|---|---|
| 3,170,158 | A | 2/1965 | Rotman |
| 3,852,762 | A | 12/1974 | Henf et al. |
| 4,595,926 | A | 6/1986 | Kobus et al. |
| 4,975,712 | A | 12/1990 | Chen |
| 5,162,803 | A | 11/1992 | Chen |
| 6,107,897 | A | 8/2000 | Mulhauser et al. |

FOREIGN PATENT DOCUMENTS

| | | | |
|---|---|---|---|
| GB | 1 511 687 | A | 5/1978 |
| GB | 2 184 607 | A | 6/1987 |
| JP | 58200605 | A | 5/1982 |
| WO | WO 02/01671 | A | 1/2002 |
| WO | WO 2004/010534 | A | 1/2004 |
| WO | WO 2005/013416 | A | 2/2005 |

*Primary Examiner* — Jack W Keith
*Assistant Examiner* — Fred H Mull
(74) *Attorney, Agent, or Firm* — Iandiorio Teska & Coleman LLP

(57) ABSTRACT

A displaced feed antenna which has a spaced conducting plate construction that incorporates electronically selectable feed points with associated antenna beam positions, and which comprises (i) a set of one or more beamforming configurations composed of layered, interlinking spaced conducting plates and conducting boundaries that are separated by cavities containing dielectric material or free space; (ii) a set of one or more internal focusing devices for each beamforming configuration to route radio frequency energy to or from the displaced feed points in receive and transmit modes respectively; (iii) a linear or curved array of displaced feeds for each beamforming configuration for coupling radio frequency energy into, or from, the cavity between the plates; (iv) a selection device to allow definable overlapping regions of the focussing devices to be illuminated for each beamforming configuration; and (v) array elements for each beamforming configuration between spaced conducting plates to free space, allowing either single polarizations or dual polarization operation.

14 Claims, 28 Drawing Sheets

Diagram 3A

Diagram 3B

Diagram 2A

Diagram 2B

Diagram 3A

Diagram 3B

Diagram 4A

Diagram 4B

Diagram 5A

Diagram 5B

Diagram 6A

Diagram 6B

Diagram 9A

Diagram 9B

Diagram 10A

Diagram 10B

Diagram 15A Diagram 15B Diagram 15C

Diagram 16A

Diagram 16B

Diagram 17A

Diagram 17B

Diagram 20A

Diagram 20B

Diagram 21A

Diagram 21B

Diagram 22A

Diagram 22B

Diagram 23A

Diagram 23B

Diagram 27A

Diagram 27B

Diagram 27C

Diagram 27D

Diagram 28A

Diagram 28B

Diagram 28C

Diagram 28D

DISPLACED FEED PARALLEL PLATE ANTENNA

FIELD OF THE INVENTION

This invention relates to a displaced feed antenna and, more especially, this invention relates to a displaced feed antenna of mostly parallel plate construction that incorporates either multiple feed points or electronically controllable feed points with associated antenna beam positions. The feed points are displaced around the focal arc or line of the antenna configuration, which will generally comprise either reflective (e.g. metal reflectors) or refractive electromagnetic (e.g. lenses) components, positioned between either the aforementioned parallel plate structure or, in certain cases, external to the said structures. The parallel plate, displaced feed antenna (i.e. beamformer) may also be interfaced directly to a radio frequency printed circuit board, comprising 1D or 2D arrays of printed antenna elements positioned on the surface of the printed circuit board, to provide thin, planar, multiple and selectable beam antennas. Within all such configurations, transitions between regions of dielectrically filled parallel plate and air filled parallel plate waveguide are advantageously introduced in order to reduce dielectric losses and to selectively exploit Fresnel diffraction by limiting electromagnetic waves to those approaching the transitions at angles greater than critical incidence.

In one such realisation, the electronically selectable feed positions may effectively overlap through the use of a linear sequence of diagonal plasma or electro-mechanical activated reflectors, relative to the transition boundary, and can be selected at increments along the transition boundary. This approach allows fine adjustment of the associated beam pointing direction and confines the feed to finite launch areas limited by critical incidence angle at the transition boundary. The extent of the launch area determines the amplitude distribution across subsequent reflective and refractive components and will consequently control far field side-lobe levels.

The present invention may be configured to facilitate the efficient transition between multiple layers of parallel plates at reflecting boundaries that compact the physical size of the antenna, avoid aperture blockage caused by the displaced feed, and can reduce the required lateral displacement of the feed from the central position to produce a particular angular deflection of the antenna beam. Layered arrays of such structures allow controlled scanning in orthogonal directions (e.g. azimuth and elevation) and may be constructed without the use of any further electronic components, such as phase shifters.

DESCRIPTION OF PRIOR ART

It is well known to use of an array of displaced feeds relative to a fixed reflector to provide a fan of selectable or simultaneous multiple beams. The use of parallel plate antenna structures to guide an electromagnetic wave is also well known. Furthermore, the use of controllable reflective structures between parallel plates has been described in conjunction with electronically controlled switched reflective devices (e.g. plasma PIN diodes and micro-actuators) and positioned between the plates to produce selectable directed beam antennas (GB-A-01/02812). The arraying or stacking of parallel plate structures has also been described.

BRIEF DESCRIPTION OF THE INVENTION

The present invention aims to simplify and extend the range of application of the prior art antenna designs discussed above by allowing the use of an array of electronically selectable displaced feeds, directed towards a fixed metal reflector where both the displaced feeds and the fixed reflector are positioned between parallel plates. Relative to prior art, the invention benefits from improved efficiency, narrower steerable beams, potentially lower manufacturing cost and in many cases reduced power consumption. Moreover, the displaced feed antenna structure of the present invention can be made more compact and efficient by folding the parallel plate structure into multiple layers at the reflecting boundaries, and in so doing avoiding aperture blockage due to the displaced feed structure.

In accordance with the present invention, there is provided a displaced feed antenna, operating at UHF, microwave, millimeter wave and terahertz frequencies, having a spaced conducting plate construction that incorporates electronically selectable feed points with associated antenna beam positions, which displaced feed antenna comprises:

(i) a set of one or more beamforming configurations composed of layered, interlinking spaced conducting plates and conducting boundaries that are separated by cavities containing dielectric material or free space; in which adjacent layers of the interlinking beamforming configuration of spaced conducting plates are in the form of folded U-turn transitions at the point of reflection and overlapping step transitions at the point of transmission, and in which the step transitions are implemented as controlled gaps in the inner common plates, which, in the case of reflection is directly in front of a conducting reflecting boundary between the outer plates, and in the case of transmission is between conducting reflecting boundaries joining the two outer parallel plates to an inner parallel plate to either side of the overlap created by the gap; in which adjacent layers between the spaced conducting plates are filled with either the same or different dielectrics and contain refractive components to aid electromagnetic collimation or focusing; and in which the conducting and reflecting boundaries are contoured and spaced to provide good radio frequency matches between dielectrics of different dielectric constants and thicknesses;

(ii) a set of one or more internal focusing means for each beamforming configuration to route radio frequency energy to or from the displaced feed points in receive and transmit modes respectively;

(iii) a linear or curved array of displaced feeds which are for each beamforming configuration and which are in the form of reciprocal transitions between radio frequency transmission lines or waveguides for coupling radio frequency energy into, or from, the cavity between the plates;

(iv) a selection means to allow definable overlapping regions of the focussing means to be illuminated for each beamforming configuration, by routing radio frequency energy to create a displaced feed, controllable in extent and position, within the array of displaced feeds; and (v) a radio frequency transition means (i.e. array elements) for each beamforming configuration between spaced conducting plates to free space, allowing either single polarisations (e.g. vertical 'V', horizontal 'H', diagonal, 'D', left hand circular 'LHCP' or right hand circular 'RHCP) or dual polarisation (e.g. V & H, RHCP & LHCP and orthogonal diagonals) operation.

The displaced feed antenna may include:

(vi) an external focusing means to work in conjunction with the internal focusing means to route incoming or outgoing energy to or from the displaced feed points in receive and transmit modes respectively;

The displaced feed antenna may include:

(vii) a selection and combining network means to allow the beamforming configurations, to be arrayed and perform single and multi-beam 2D scanning.

The displaced feed antenna may be one in which the same or different dielectrics are air, silicon, or radio frequency PCB material and the refractive components are such as a flat Luneburg lens, to aid the electromagnetic collimation or focusing.

The good radio frequency matches between dielectrics of different dielectric constants and thicknesses are able to provide (i.e. minimum reflection back towards the source).

The displaced feed antenna may be one in which the reflecting boundaries are either continuous conducting walls between conducting plates or arrays of closely spaced (i.e. very much less than half a wavelength) electrically conducting vias or columns between the conducting plates. The said spaced conducting plates may be made from any sufficiently conducting material, for example thin metal sheets or deposited metal.

The displaced feed antenna may be one in which the linear or curved arrays of displaced feeds are in the form of reciprocal transitions between radio frequency transmission lines (e.g. coplanar or micro-strip lines) and spaced conducting plate, where an optional power detection means taps power off each transmission line to determine radio frequency activity across all the beams and so provides an indication of which beam to select.

The displaced feed antenna may be one in which the selection means to route radio frequency energy to and from individual and adjacent elements is either an active parallel plate solid state plasma commutating device or a multi-way radio frequency switch configuration or a radio frequency micro-electromechanical multi-way switch configuration.

The displaced feed antenna may be one in which the selection means is able selectively provide phase shifts, time delays and variable attenuation capabilities, as required, to improve the sidelobe performance of the displaced feed antenna.

The displaced feed antenna may be one in which the relative lengths of the transmission paths between the input selection means and displaced feed are designed to provide controllable time delays to steer the beam in the orthogonal dimension.

The displaced feed antenna may be one in which the external focussing means is a reflective extrusion or a reflective surface of revolution to allow further control of beamwidth and sidelobe levels, where the cross sectional shape may also allow asymmetric beam shape weightings.

The displaced feed antenna may be one in which the internal focusing means to route radio frequency energy to or from the displaced feed points on receive and transmit, respectively, is either a reflecting or refracting transition in the form of a U-turn or step transition or a graded index change in inter-plate dielectric, respectively, or some combination thereof, and following either a linear, parabolic, a circular boundary or some suitable variation or distortion thereof, to result in either a collimated, partially collimated or a focused beam at the transition from the spaced conducting plate to free space. The displaced feed antenna may be one in which the internal focussing means is a flat Luneberg lens of graded refractive index embedded within a centrally folded parallel plate structure. The displaced feed antenna may include an embedded 'parabolic' reflector where a third order 'distortion' term has been introduced to provide an approximately cosecant squared beam shape. The displaced feed antenna may include an embedded reflector where a small displacement of the feed results in large displacement of the focus, due to the displaced feeds having been moved away from the reflector's focal arc and an optical magnification effect having been introduced.

The displaced feed antenna may be one in which the transition between the spaced conducting plates and free space are either steps, U-turns or right angles and connect to appropriately orientated linear or curved array of launch elements, in the form of a linear flared horn, linear array of patches, a linear array of printed horn structures, a curved flared horn, a curved array of printed patches or curved array of printed horns. The displaced feed antenna may be one in which the launch elements either transit directly from the parallel plate or via linear, radial or curved transmission lines, such as micro-strip or coplanar lines. The displaced feed antenna may be one in which the spaced conducting plates share a single common ground plane with the printed transmission lines and launch elements. The displaced feed antenna may be one in which the launch elements are so coupled by slots or connected by metal pins through linear, tapped delay lines (or waveguides) or corporately fed structures to provide a range of polarisations. The displaced feed antenna may be one in which the launch elements have orthogonal polarisation inputs and their feeding structures can be fed by either single or multiple, spaced conducting plate, beamforming systems, to allow either all polarisations to be formed when their radio frequency ports are phase and amplitude weighted or provide independent multiple beam operation using opposite polarisations. The displaced feed antenna may be one in which the U-turn and right angle transitions are introduced to interface correctly to the launch elements but also to achieve the desired trade-offs between x, y and z dimensions of the assembled antenna configuration. The displaced feed antenna may be one in which the right angle transition to an array of printed patches is implemented as an radio frequency printed circuit board, with printed lines, feeding the patches, spaced at less than half wavelength and placed directly in front of half wavelength slots that are positioned between and edge of the spaced conducting plates, so providing an efficient right angle transition without the use of right angle connectors. The displaced feed antenna may be one in which the corporate feed to the antenna elements has incrementally added line lengths to steer the beam away from boresight in order to reduce spillover if there is a reflector present or allow flat to the wall mounting when the elevation beam is required to point upwards.

The displaced feed antenna may be one in which the external focusing means are arranged such that the linear or curved array of launch elements are along the focal lines and arcs of either a singly or a doubly curved reflecting surface to so produce a collimated or partially collimated beam in a direction related directly to the displaced feed's or group of adjacent feeds' linear or angular positions. The displaced feed antenna may include external singularly curved 'parabolic' reflector, where a third order 'distortion' term has been introduced to provide an approximately cosecant squared beam shape.

The displaced feed antenna may include a displaced feed parallel plate selection unit, which uses electronically or electromechanically controllable reflective surfaces (i.e. zero refection equals lossless transmission), the displaced parallel plate selection unit being is positioned directly between spaced conducting plates of the beamformer to provide a highly integrated launch into parallel plate, subsequent inter-plate step transitions and subsequent transitions into transmission lines. The displaced feed antenna may be one in which the first launch into the parallel plate is be either through a single element fed by a single line or guide or an array of elements fed by an equal number of lines of guides to allow for further beamforming control on launch or monopulse operation. The displaced antenna may be one in which the said controllable reflective surface is in the form of either a diagonal mirror embedded in a dielectric slab, which can be linearly displaced along the focal line or an open elliptical mirror embedded in a dielectric disk, which can be angularly displaced around a focal arc. The displaced antenna may be one in which both selection means are able to transit, using a step transition, from spaced conducting plates into patterned transmission lines to any required pattern of displaced feeds:

The displaced antenna may be one in which the selection means is mechanically supported by the next layer of parallel plate, which can take the form of a multi-layer radio frequency printed circuit board, with both radio frequency and DC control tracks for the selection of the displaced reflective surfaces.

The displaced feed antenna may include an optional selection and combining network to allow the beamforming configuration to perform multi-beam scanning in two dimensions and in which multiple spaced conducting plates are configured in a stack and can be fed either corporately over the stack and where each adjacent displaced feed has an incremented time delay associated with it, achieved through a small displacement of the selecting reflecting surface or, alternatively through a further spaced conducting plate network, and which acts as an orthogonal beamforming network capable of illuminating the stack with appropriately delayed signals to cause orthogonal scanning of the beam.

The displaced feed antenna may be one in which multiple orthogonal beamforming networks are introduced to appropriate displaced feeds around a stack of beamformers to provide simultaneous multiple beam scanning in one dimension.

The displaced feed antenna may be one in which useful beam distortions, such as cosecant squared, are implemented either by distorting internal and external reflectors or refractors or multiple displaced feeds are phase and amplitude weighted to provide the same effect.

The displaced feed antenna may be one in which low noise amplifiers and power amplifiers are introduced into transmission lines feeding array elements to compensate for line losses and distribute power devices to so improve sensitivity and increase power transmitted respectively.

By arraying the displaced feed structures, usually at or below half wavelength spacing, and using the displaced feed to provide simultaneously both an angular (i.e. spatial) and a temporal displacement, the so produced beam may be scanned semi-independently in two orthogonal dimensions.

The antenna system of the present invention may be a compact, layered, high efficiency, monolithic antenna which is appropriate for use throughout and beyond the microwave and millimeter radio spectrum. The antenna may be produced as a rugged, low cost, narrow or wide beam system which is designed to point a radio frequency beam in a fixed direction, particularly suitable for wireless local area networks satellite and automotive applications. If the selection means is replaced by individual front ends, a switched, multi-beam, parallel plate antenna can be configured. If required, the present invention may utilise both switched and fixed beams within the same structure. The fixed beams will consume no power and allow for the cueing of the switched beams. The selection means may be configured to feed one or more inputs at a time. The feeding of more than one input, with appropriate phase and amplitude, can significantly enhance performance. The selection means may consist of an radio frequency switch network or a plasma commutating device. When separate radio frequency switches are used separate phase shifters, time delays and variable attenuators may be introduced to improve the sidelobe performance of the antenna. If a switch network is used, this may consist of a single input which is split to feed a number of multi-way switches to allow the illumination of two or more adjacent inputs, the phase shifters, time delays and attenuators can be introduced prior to the switch and in general will be fewer in number than for an equivalent performance, phase or time steered antenna. The beamforming sections may be duplicated twice to allow either dual polarisation operation over two independent beams or full polarisation control over one beam. The beamforming sections may be stacked and when appropriately fed orthogonally via further beamforming perform independent multi-beam scanning. Where higher sensitivity or transmission power is required, (e.g. satellite applications) low noise or power amplification may be introduced to further extend the performance of the antenna.

The antenna of the present invention may have the following advantageous characteristics:

- Low loss and high efficiency;
- Low cost monolithic components for beam selection;
- Low spatial side lobes;
- Integral attenuation and side lobe control, requiring low DC power (optional);
- Enhanced gain and power handling (optional);
- Multiple fixed and scanning beam capability (optional);
- Dual polarisation operation allowing all polarisation to be synthesized;
- Upgradeable or extendable from a single fixed beam to a multiple switched beam or a combined system;
- Integrated low noise and power amplification for enhanced receiver and transmitter performance;

A further benefit of displaced feed parallel plate antenna is that the system design of a parallel plate antenna is complex and normally involves a combination of ray tracing to define the basic antenna geometry and full electromagnetic simulation to optimise the antenna's parameters, efficiency and side lobe performance. The essential structure of the antenna is planar and this means simulations can be sub-divided into layered components and then joined together to create more complex structures, currently untenable as a single electromagnetic simulation structure. Essentially, the same simulation is required for both the switched, single narrow beam parallel plate design and the multiple narrow beam parallel plate design. This results in a significant savings in effort and cost in producing contemporaneously antenna designs suitable for both switched and multiple beam applications.

BRIEF DESCRIPTION OF DRAWINGS

Embodiments of the invention will now be described solely by way of example and with reference to the accompanying drawings.

DESCRIPTION OF PREFERRED EMBODIMENTS

Figure 1:
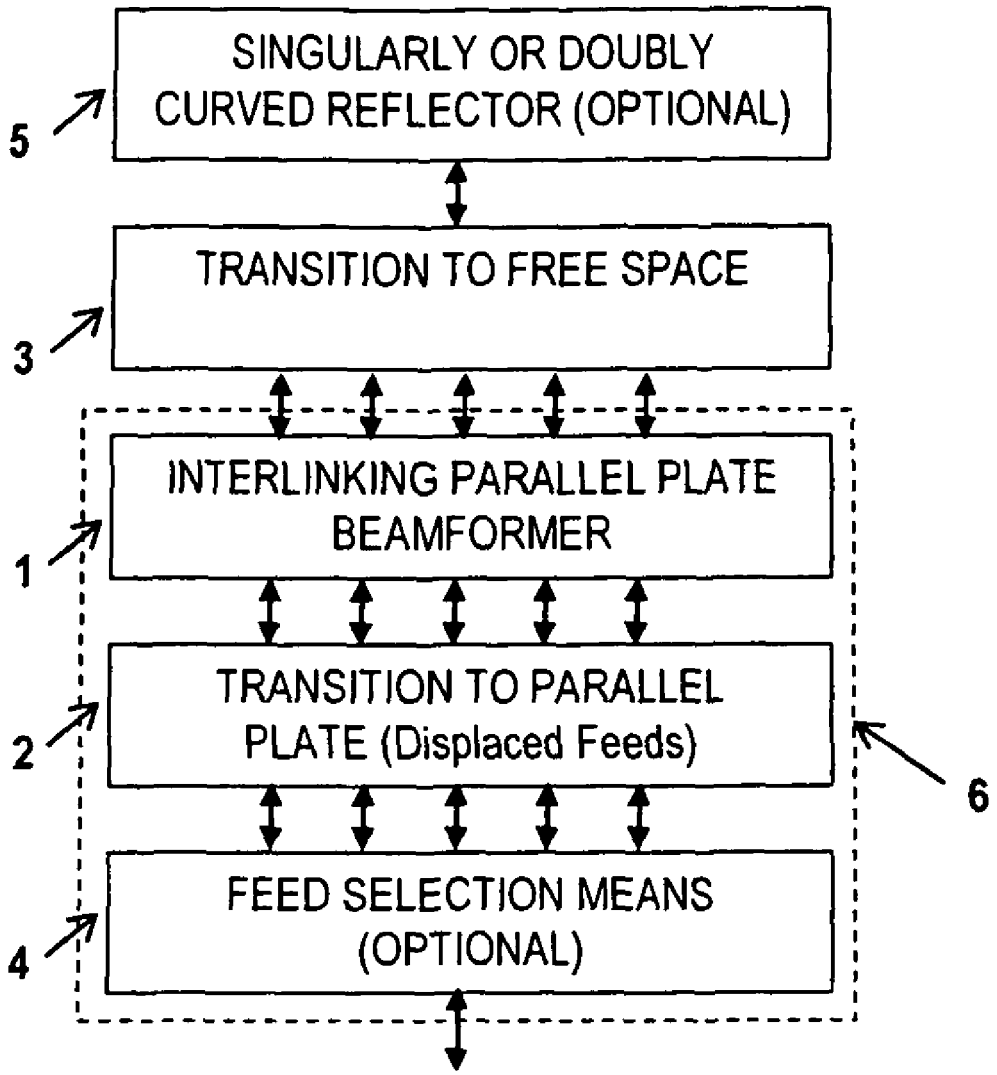
FIG. 1 is a block diagram of a displaced feed, parallel plate antenna configuration.

Referring to the drawings, the underlying components and scope of the present invention are identified at a top level in FIG. 1. Here, a block diagram shows both the essential and the optional elements of the displaced feed antenna. Assuming the antenna is in transmit mode, the essential elements are a parallel plate beamformer 1, a transition into the parallel plate 2 and a transition out of the parallel plate 3. The transition into the parallel plate beamformer 2, in one non-limiting embodiment, might be an array of displaced feeds connected directly to either an array of radio frequency front ends (not shown) or an optional feed selection means 4 connected to a single radio frequency front end (not shown). The transition out of the parallel plate beamformer 3 into free space, in one non-limiting embodiment, might be either a single elongated flared horn or an array of sub-transitions individually feeding multiple printed transmission lines that, in turn, feed arrays of radio frequency printed structures on single or multiple radio frequency printed circuit boards. All such transitions out the parallel plate 3 may be followed by either an optional singularly or an optional doubly curved reflector 5, the geometric form of which depends on the internal layout of the parallel plate beamformer 1 and the nature and layout of the transitions out of the parallel plate 3. In the case, of the singularly curved reflector the beamformer 1 is required to produce a cylindrical wavefront. In the case of the doubly curved reflector, the beamformer 1 is required to produce a spherical wavefront.

In one non-limiting embodiment, the optional selection means 4, the transition into parallel plate 2, and the parallel plate beamformer 1 may be advantageously amalgamated into a single physical embodiment 6, which performs all three functions of the displaced feed beamformer.

Figure 2:
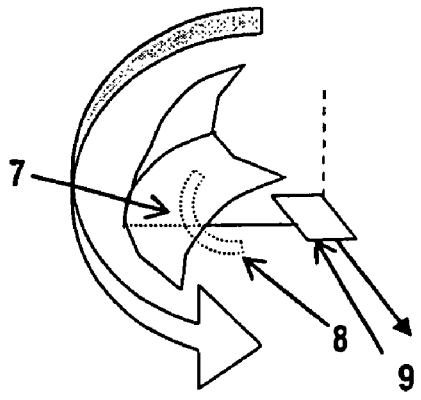
FIG. 2 shows a displaced feed antenna configuration employing a doubly and singularly curved reflector.
Figure 2:
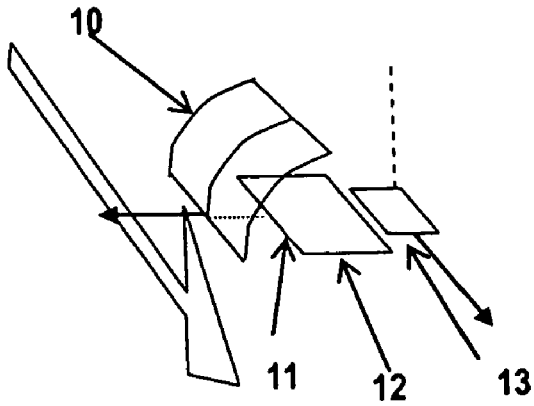

In order to illustrate and explain by way of general introduction only alternative physical layouts of the antenna utilising the optional doubly or singularly curved reflectors, FIG. 2, in Diagrams 2A and 2B, compares two non-limiting realisations of the displaced feed antenna for transmit operation. In Diagram 2A, the doubly curved reflector 7 has a focal arc 8 at which the transition out of the parallel plate 3 is configured. The transition out of the parallel plate 3 is fed via a single physical embodiment 6 of the displaced feed beamformer 9. In Diagram 2B, the singularly curved reflector 10 has a focal line 11 at which the transition out of the parallel plate 3 is fed via an integrate parallel plate beamformer with an input of displaced feeds 12, that can be selected by selection means 4 in the form of a multi-way commutating switch 13.

The antennas described herein operate in both transmit and receive modes and are totally reciprocal in operation. The antennas, as described, contain no unidirectional elements. It is intended that when an explanation is given for one mode (e.g. transmit), the reverse mode (e.g. receive) follows without further elucidation. However, it is recognised that unidirectional devices, such as amplifiers may be added to the configurations so described to improve sensitivity or power handling and remain within the general scope of the invention. Various aspects of the present invention will now be discussed in greater detail.

Figure 3:
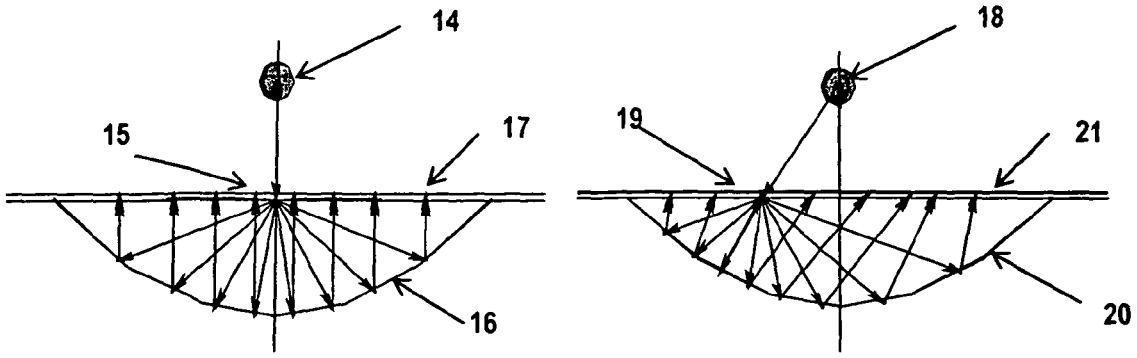
FIG. 3 shows a linearly displaced feed set along a focal line producing in collimated beam within a beamformer.

FIG. 3, in Diagrams 3A and 3B, compares the geometric operation of the parallel plate beamformer 1 for two different displacements of the feed. In Diagram 3A a simple commutating device 14 is used as the selection means 4 to a centrally positioned transition 15 into the parallel plate beamformer 1, which employs a parabolic reflector 16 with a central focal point at the transition 15. A collimated beam is generated by the parabolic reflector and leaves the parallel plate as cylindrical wave via a linear transition to free space 17. In Diagram 3B, for the displaced case, the operation is much the same, except the commutating device 18 is set differently to feed a displaced transition 19 to the parabolic reflector 20, which has a linearly offset focal point at the transition 19. An approximately collimated beam is generated by the parabolic reflector with an offset feed and leaves the parallel plate as conical wave via a linear transition to free space 17. Multiple beam operation may be obtained by omitting the commutating device shown as 14 and 18, which is optional, and utilising multiple linearly displaced feed points with separate radio frequency front ends (not shown).

Figure 4:
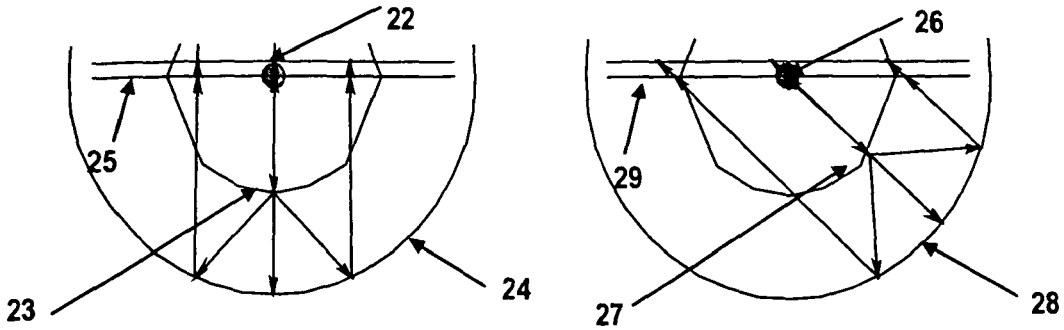
FIG. 4 shows a circularly displaced feed set along a focal arc producing in collimated beam within a beamformer.

FIG. 4, shows for two cases, in Diagrams 4A and 4B, a configuration similar to FIG. 3, except the reflector within the parallel plate beamformer 1 is circular and has a circular focal arc rather than a focal line. In Diagram 4A, a simple commutating device 22 is used as the selection means 4 to a centrally positioned transition 23 into the parallel plate beamformer 1, which employs a circular reflector 24 with a central focal point at the transition 23. An approximately collimated beam is generated by the circular reflector, which satisfactorily approximates to a parabola, provided only a limited region of the circular reflector is illuminated, and the wave exits the parallel plate as a cylindrical wave via a linear transition to free space 25. To achieve satisfactory illumination of the circular reflector 24, it is sometimes necessary to amplitude and phase weight adjacent displaced feed points, depending mostly on the aperture and associated beamwidth of the individual displaced feeds. In Diagram 4B, for the displaced case, the operation is much the same, except the commutating device 26 is set differently to feed a circularly displaced transition 27 to the circular reflector 28, which has a circularly offset focal point at the transition 27. An approximately collimated beam is generated by the circular reflector and leaves the parallel plate as a conical wave via a linear transition to free space 29. Multiple beam operation may be obtained by omitting the commutating device shown as 22 and 26, which is optional, and utilising multiple circularly displaced feed points with separate radio frequency front ends (not shown). Ignoring edge effects, a potential advantage of the circular reflector is that the reflected pattern of rays, and hence the wavefront, is independent of the displacement.

Figure 5:
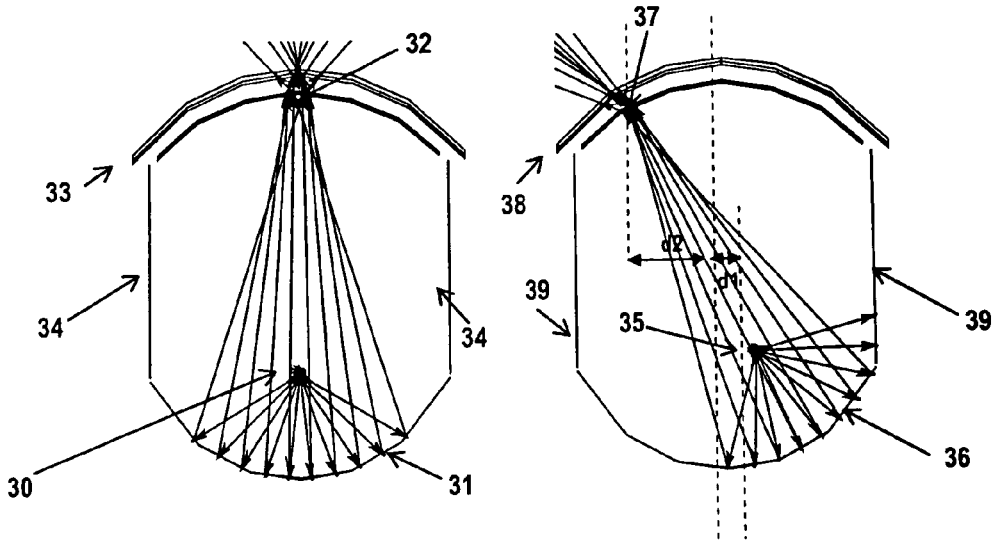
FIG. 5 shows a circularly displaced feed along a non-focal arc producing a focused beam within a beamformer and illustrating an associated optical levering effect.

FIG. 5 illustrates for two cases, in Diagrams 5A and 5B, a further variation on the parallel plate beamformer 1 which makes use of an optical levering effect and is typically used with a doubly curved reflector 7. In Diagram 5A, for the centrally fed case, a parallel plate beamformer 1 is fed via a central feed 30, directed at a circular reflector 31, such that a focus is formed a significant distance forward of the central feed 30 at a transition point 32. The transition 32 into free space might be via a flared horn 33 and would be such that it were at the focus of a double curved reflector 7, (not shown in FIG. 5). It will be noted, that the straight edges of the parallel plate 34 absorb the wave. In Diagram 5B, for the displaced case, a parallel plate beamformer 1 is fed via an offset feed 35, laterally displaced by a distance 'd1' and directed at a circular reflector 36, such that a focus is formed a significant distance forward of the central feed 35 and laterally displaced by a distance 'd2', to provide a levering or magnification factor (i.e. d2/d1) greater than '1' at a transition point 37. The transition 37 into free space might be via a flared horn 38 and would be such that it were at the focus of a double curved reflector 7, (not shown in FIG. 5, but discussed below under FIG. 9). It will again be noted, that the straight edges of the parallel plate 39 absorb the reflected wave. An optional commutating device (not shown) may be used to achieve the initial displacement, alternatively separate receivers may be placed at each displaced feed point. The configuration, shown in FIG. 5, has the potential advantage that a small lateral displacement results in a large lateral displacement, such that transmission line losses may be significantly reduced by the introduction of low loss parallel plate waveguide.

Figure 6:
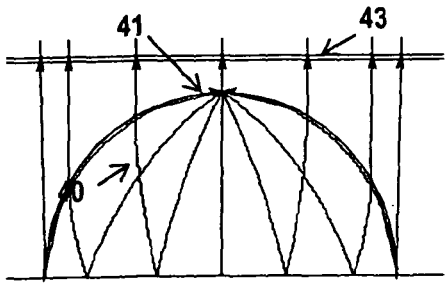
FIG. 6 shows a circularly displaced feed along the focal surface of a semi-circular Luneburg lens embedded within a beamformer.
Figure 6:
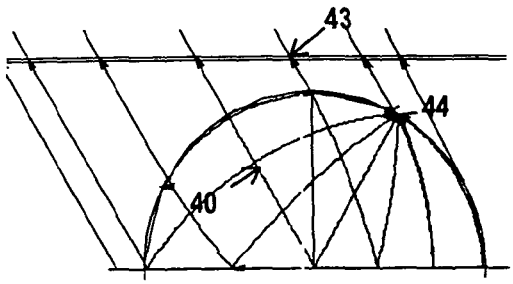

FIG. 6 shows for two case in Diagrams 6A and 6B a parallel plate beamformer 1, between which a thin semi-circular Luneburg lens 40 has been embedded. A thin, semi-circular Luneburg lens is a graded refractive index lens, with a dielectric gradient from k=2 at the centre to k=1 at the surface, where k is the graded refractive index of the lens. In practice this gradient is accomplished by an assembly of concentric shells with varying dielectric constants and low dielectric losses. The lens will then focus incoming plane waves to a point at or near the lens surface. Referring to FIG. 6, which contrasts launches from feeds at the centre, (Diagram 6A), and an offset position around the circumference of the lens, (Diagram 6B), it will be noted that radio frequency wave is fed from the lens surface into the semi-circular Luneburg lens 40, via either a central transition 41 or an offset transition 44. The radio frequency wave then reflects off a flat mirror 42, which effectively halves the size of lens, by folding the lens along its diameter, and produces an outward wave that finally exits the parallel plate into free space via a linear transition 43. The advantage of the embedded lens over the air-filled parallel plate geometry is that the lens may allow only one input feed to be fed, rather than requiring a number of feeds to be fed (and possibly weighted) in the other considered cases. However, the lens will have associated dielectric losses, increased cost and will also add to the weight of the overall antenna configuration.

Figure 7:
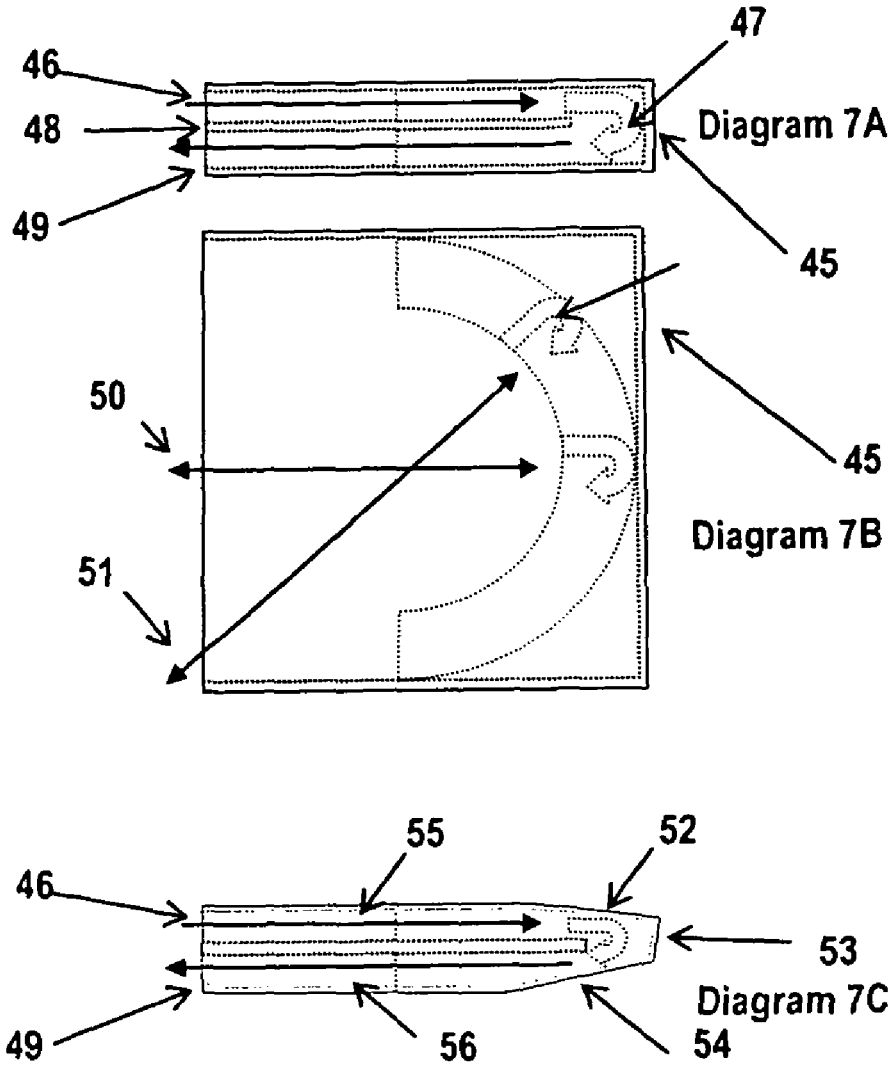
FIG. 7 shows a U-turn transition between upper and lower parallel plates.

FIG. 7 depicts, in Diagram 7A, 7B and 7C, a two layer, parallel plate beamformer 45, in both cross-cut and plan views. Referring to both Diagrams 7A and 7B, for the receive case, an electromagnetic wave enters the top parallel plate 46 via an appropriate transition such as a flared horn, (not shown, but discussed previously). The distance between the parallel plates must at all points be such that only the transverse electromagnetic mode is supported, which is typically less than a half wavelength. On approaching the curved reflector, the electromagnetic wave enters a transition region 47 that causes the wave to perform a U-turn from the top parallel plate 46 to the bottom parallel plate 49. The transition 47 is essentially a sub-wavelength gap in the common centre plate (see cross-cut view, Diagram 7A) dividing the top and the bottom plates and following the shape of desired reflector (e.g. circular or parabolic), which is a conducting wall between the upper and lower parallel plates, directly behind the centre gap. The dimensions of the centre gap, control the range of frequencies that can pass between the top and the bottom parallel plate structures without significant attenuation. By varying the width of the gap, (e.g. wide in the centre, narrow at the edges), amplitude tapers may be advantageously introduced and applied to the electromagnetic wave to control the aperture taper and resulting sidelobes in the far field. It should be observed that when the wave does not approach the gap normally, the band-pass characteristics of the gap change as the incidence angle changes. On entering the bottom parallel plate 48, the wave re-establishes itself, travelling in the opposite direction where it may for example converge to a focus where it might for example transit into a micro-strip line, (not shown). It is important to realise that this simple two layer parallel structure has completely removed feed blockage. Moreover, both measurements and simulations have confirmed that the reflection parameters can be kept small provided the dimensions of curved U-turn transition are carefully optimised, most easily through the use of an appropriate proprietary electromagnetic simulation package. The rectangular form of the two layer beamformer 45 is for illustrative purposes only and in practice may be adjusted to provide optimal performance, bearing in mind the sidewalls of parallel plate need to be terminated with either a reflecting or an absorbing boundary and the input and output transitions may also be curved to meet internal and external reflector geometries. The upper 55 and lower 56 parallel plates may be filled with dielectric, and provided a match can be obtained between the top and bottom parallel plate waveguides different dielectrics may be used in the guides. This match can be adjusted by profiling (e.g. tapering) the upper 52, reflector 53 and lower 54 parallel plate surfaces in the region of the transition, as, for example, shown as a cross-cut view in Diagram 7C.

Figure 8:
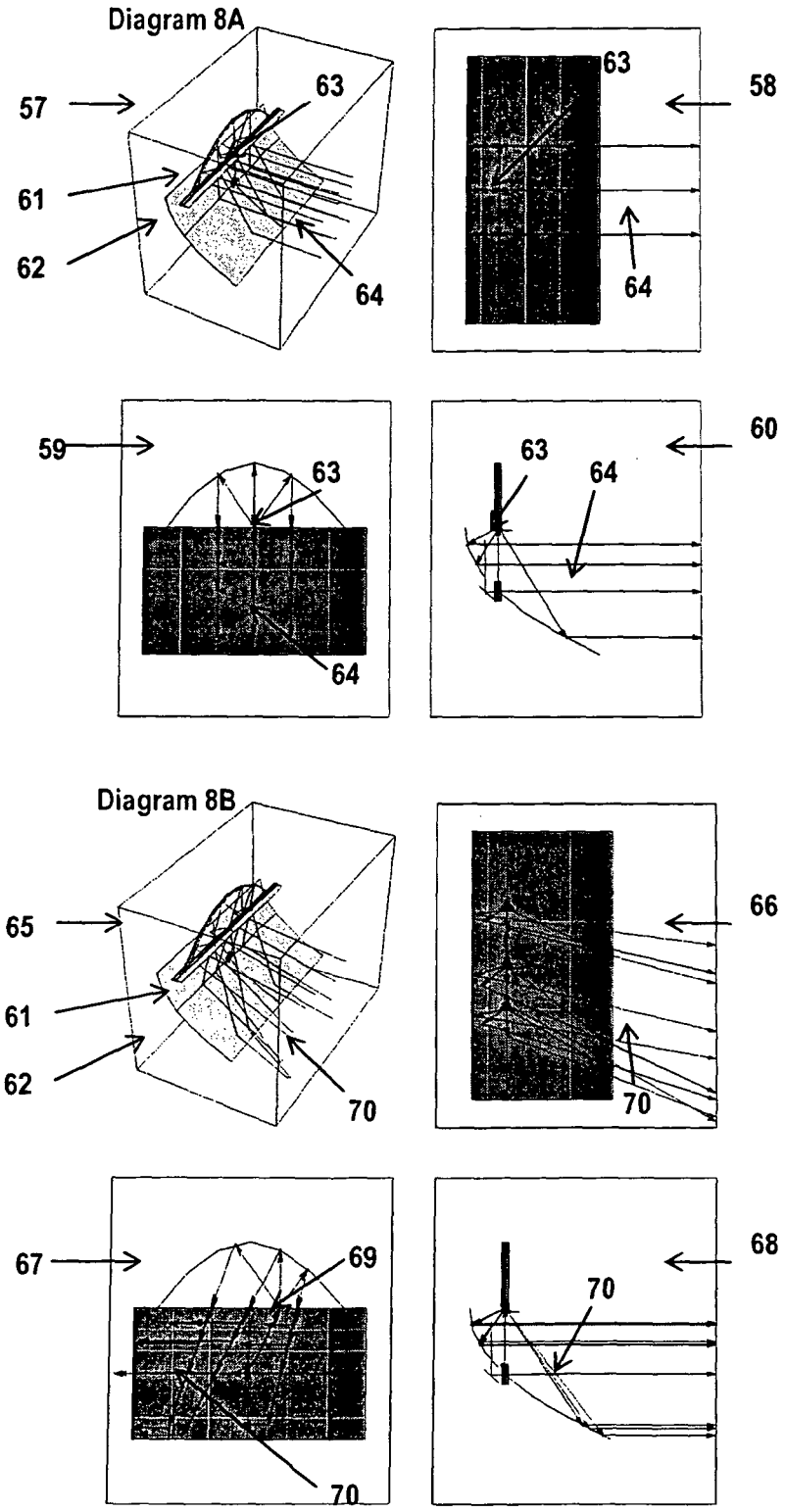
FIG. 8 shows a linearly displaced feed antenna configuration with a singularly curved reflector.

FIG. 8 contrasts in Diagrams 8A and 8B two different feed displacements. The top four perspectives (Diagram 8A), show an outward going ray trace of a parallel plate antenna in perspective 57, top 58, front 59 and side views 60, with a parabolic beamformer 61 utilising a singularly curved reflector 62, in the form of an offset parabolic extrusion. The rays are launched at the focus 63 of the parabolic reflector within the parallel plate waveguide and result in a collimated collection of rays progressing through the antenna configuration in the way shown. The rays leave the parabolic parallel plate beamformer via a linear transition at the focus of the offset parabolic extrusion 62 and result in a cylindrical wavefront, normal to the radial rays, impinging on the extruded parabolic reflector and being translated into a planar wavefront normal to the collimated collection of rays 64 bouncing off the reflector 62.

In contrast, to the top four perspectives, (Diagram 8A), the bottom four perspectives (Diagram 8B), show an outward going ray trace of a parallel plate antenna in perspective 65, top 66, front 67 and side views 68, with a parabolic beamformer 61 utilising a singularly curved reflector 62, in the form of a simple parabolic extrusion. However, the rays are launched from a displaced focus 69 of the parabolic reflector within the parallel plate waveguide and result in an approximately collimated collection of rays progressing through the antenna configuration in the way shown. Essentially, the parallel plate beamformer produces an approximately cylindrical wavefront normal to the rays leaving the beamformer, which is translated by the extruded parabolic reflector into an approximately planar wavefront and associated group of rays 70 at an azimuth angle approximately proportional to the linear displacement of the launch point.

Figure 9:
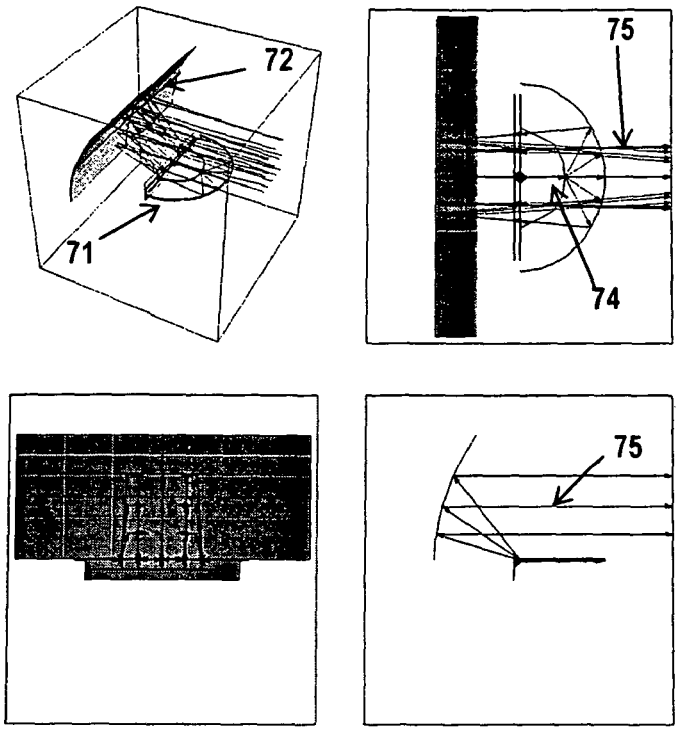
FIG. 9 shows a circularly displaced feed antenna configuration with a singularly curved reflector.
Figure 9:
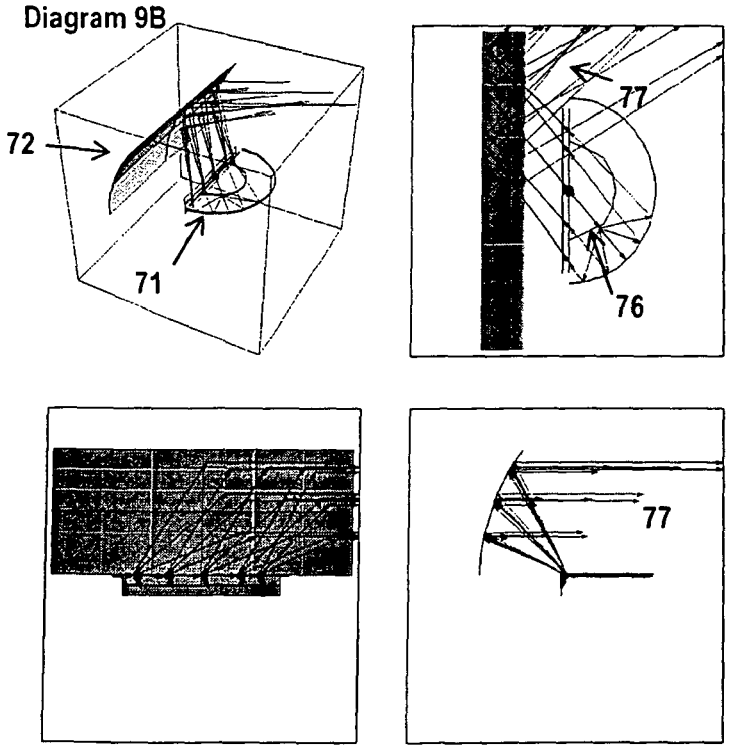

FIG. 9, in Diagrams 9A and 9B, follows the same format described for FIG. 8, except that the parabolic reflector 62 within the beamformer has been replaced by a circular reflector. Moreover the offset parabolic extrusion 72 and the beamformer 71 have been repositioned to show more clearly the complete outward ray trace. The central and displaced launch points 73 and 75 for the ray trace now lie on a circular arc and the displacement angle is now proportional to the generated azimuth angle of the beam (i.e. the collection of rays 74 and 76) leaving the parabolic reflector for the two considered launch points 73 and 75.

Figure 10:
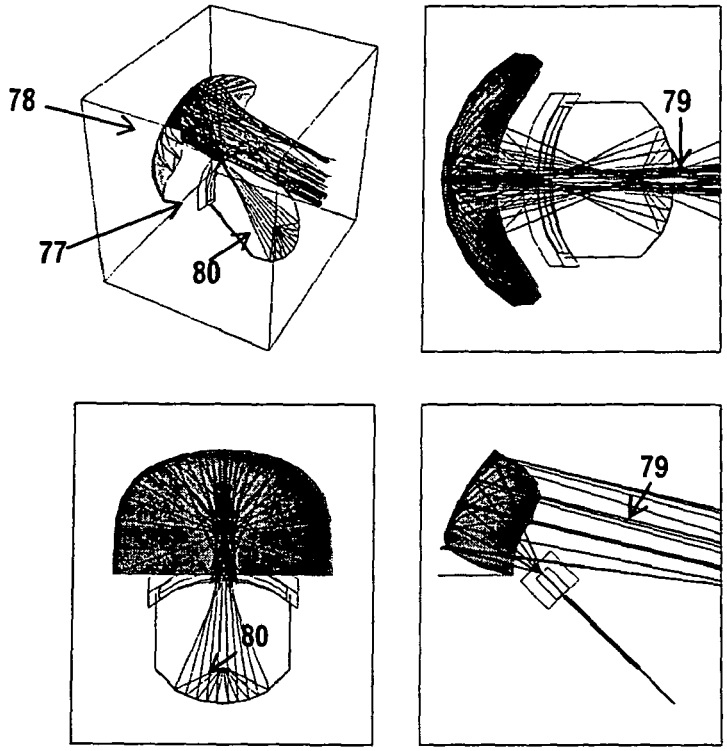
FIG. 10 shows a circularly displaced feed antenna configuration with a doubly curved reflector.
Figure 10:
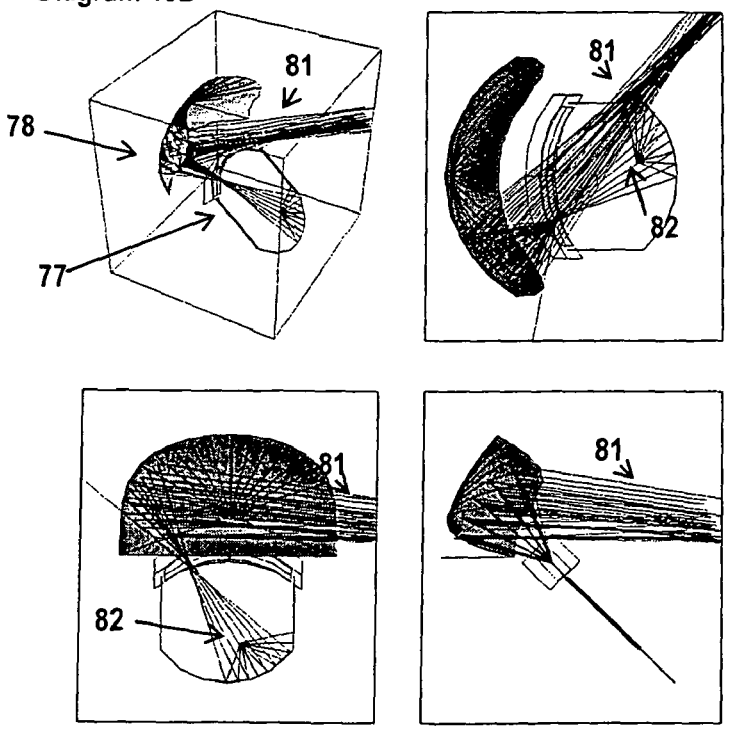

FIG. 10, in Diagrams 10A and 10B, follows the same format described for FIGS. 8 and 9, exploit the optical parallel plate beamformer 77, already described by way of FIG. 5, has been introduced to exploit the optical magnification effect and a doubly curved parabolic surface of revolution surface revolution 78, has been used to approximately collimate the group of rays leaving the antenna configuration 80 and 82, arising from the centre 81 and the displaced 83 launch points respectively. It will be noted that the parallel plate beamformer has been positioned to lie close to the focal arc of the parabolic surface of resolution reflector. In the special case of the beamformer being positioned exactly in focal plane of the parabolic surface of resolution and the beamformer having an upward pointing circular launch coincident with the focal arc of the parabolic surface of resolution, a perfectly collimated (i.e. no geometric aberrations) arrangement can be achieved, except those due to the circular cross-section of the parabolic surface of resolution approximating to a parabola. However, a more easily achievable arrangement is possibly to tilt the beamformer in the way shown in FIG. 10 and accept some geometric aberrations with scan.

Figure 11:
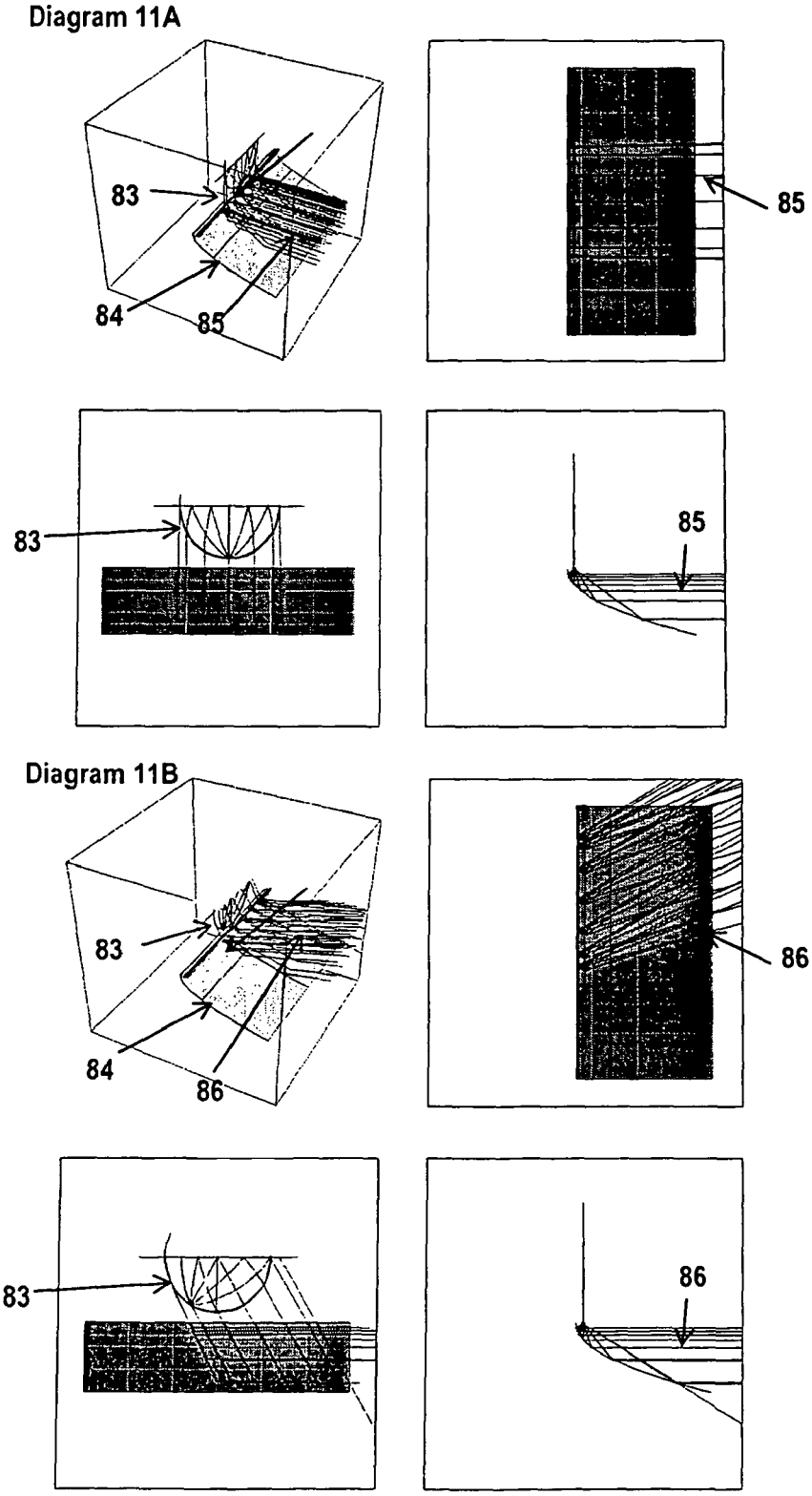
FIG. 11 shows a circularly displaced feed antenna configuration, employing a semi-circular Luneburg lens, with a singly curved reflector.

FIG. 11, in Diagram 11A and 11B, follows the same format described for FIGS. 8, 9 and 10, except the parallel plate beamformer 77, now employs a semi-circular Luneburg lens, previously described by way of FIG. 6, which has here been introduced to feed, with reduced distortion over a greater angular range, a singularly curved parabolic reflector 78. The angular displacement of the launch point around the perimeter of the Luneburg lens equals the azimuth scan angle of the beam, represented in FIG. 11 as the group of collimated rays 85 and 86, leaving the antenna configuration for the broadside and off-broadside cases.

To summarise, FIGS. 8, 9, 10 and 11, all employ novel displaced feed techniques in conjunction with the multilayer parallel plate approach shown in FIG. 7, to effectively illuminate either reflective parabolic extrusions or parabolic surface of resolution reflectors. The choice of reflector scheme depends on a wide variety of factors directly related to the cost of manufacture and antenna performance. For example, a parabolic surface of revolution approach may provide a wider field of view, but be more expensive to produce than the parabolic extrusion. Another important consideration is the physical size of the antenna which, for the schemes described so far, is governed by the chosen reflector's dimensions that in turn controls the antennas beamwidth and field of view. More compact flat radio frequency printed circuit board alternatives (e.g. patch arrays) will be discussed later in this section, discussing preferred embodiments of the displaced feed antenna.

Figure 12:
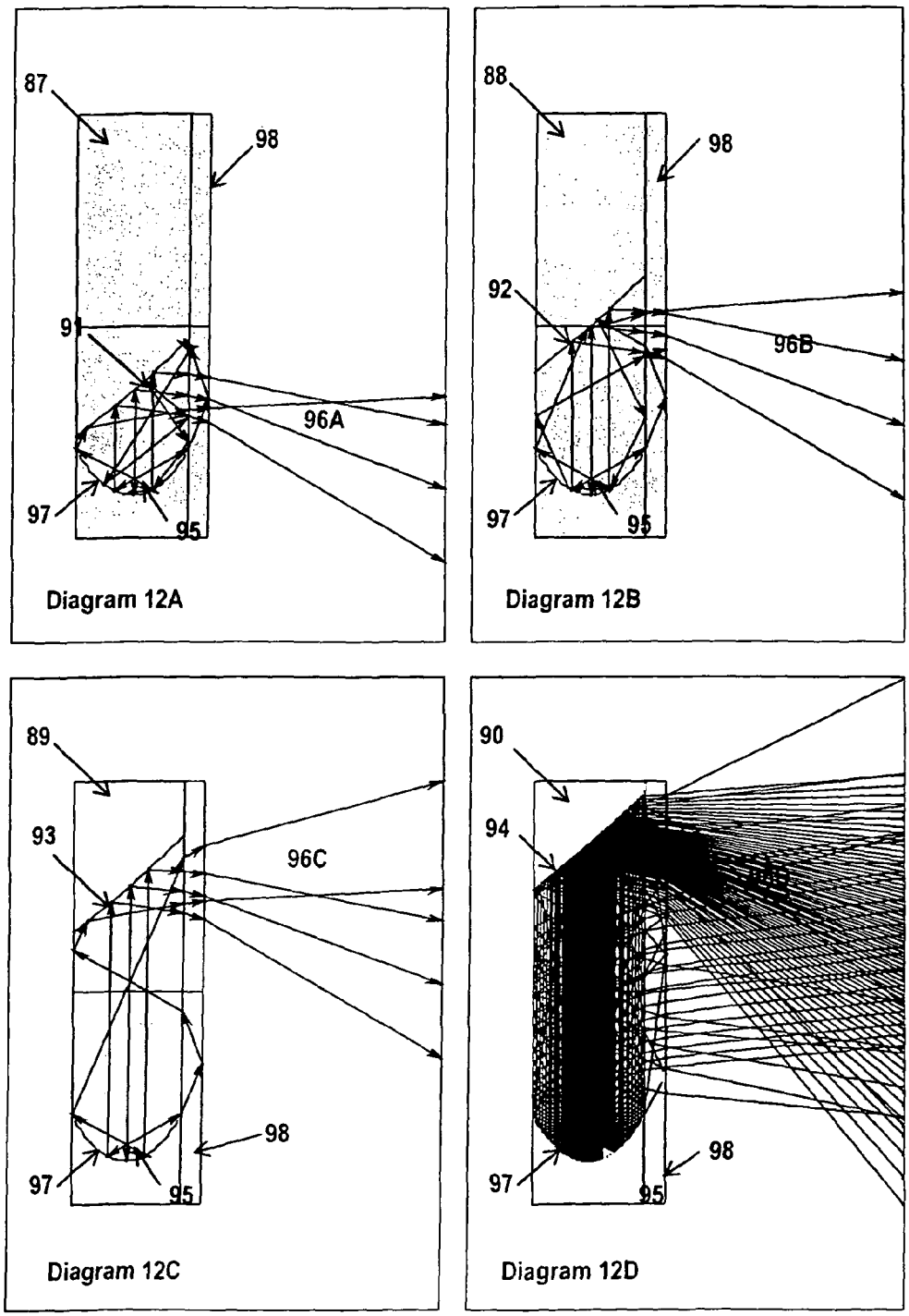
FIG. 12 shows an electronically selectable, linearly, displaced, diagonal feed, positioned within a rectangular parallel plate configuration.

FIG. 12 shows, in Diagrams 12A to 12D, four instances of a rectangular, displaced feed subsystem 87, 88, 89 and 90, for four different feed displacements. Introducing diagonal 'on/off' reflector components 91, 92, 93 and 94, such as plasma generating PIN diodes or a micro-actuated reflectors, between dielectrically loaded parallel plates, enables the feed selector, feed, parallel plate beamformer and launch to be combined in one highly integrated component. The displaced feed subsystems comprise a dielectrically loaded parallel plate 87, 88, 89 and 90, between which a fixed feed point is introduced, such as an omni-directional element 95, (e.g. a simple coaxially fed monopole, with the outer metal shield connected to the lower plate and the inner metal core connected to the top plate), at the focus of a parabolic reflector (e.g. simply created by discrete electrical vias between the plates at a spacing very much less the half wavelength), 97. This parabolic feed configuration 97 produces a highly collimated beam (shown as parallel rays) that, as shown clearly in the fourth illustrated case 94 where more rays have been launched, is mostly contained within the confines of the rectangular dielectric slab, due the Fresnel boundary being such that critical incidence conditions apply on the non-radiating sides of the parallel plate slab, provided the refractive index of the dielectric slab is much greater than that of the surrounding media. The highly collimated beam next impinges upon one of the diagonal reflectors, either 91, 92, 93 or 94, in its 'on' (i.e. reflective) state. The collimated beam is thus selectively turned through 45° and directed towards a matched transition into free space 98. The matched transition 98 might be, for example, a simple quarter wavelength matching or blooming layer, where the permittivity of the matching layer is equal to the square root of the permittivity of the main dielectric. Alternatively, the non-reflective impedance match may be obtained by a gradual (or stepped) widening of the distance between the parallel plates. The resulting output beams (either 96A, 96B, 96C or 96D) are appropriately displaced to illuminate an external reflector, (not shown) which might be either in free space and appropriately offset to minimise blockage or a U-turn reflector (shown previously in FIG. 6) placed within direct continuation of the parallel plate. In the case of the latter, the parallel plate may be dielectrically loaded or air filled, in which case the matching transition 98 will still be required. The size of the displaced diagonal mirror directly controls the beamwidth of the beam leaving the slab and hence the sector of the external mirror illuminated. The diagonal mirror's size is governed by the width of the slab. One major benefit of this configuration is that the diagonal reflector 91 may be adjusted in very small, sub-half wavelength displacements, making very fine beamsteering possible, together with very fine adjustment of relative time delay, a feature facilitating partial 3D beamsteering which will be further discussed below in the context of FIG. 24.

Figure 13:
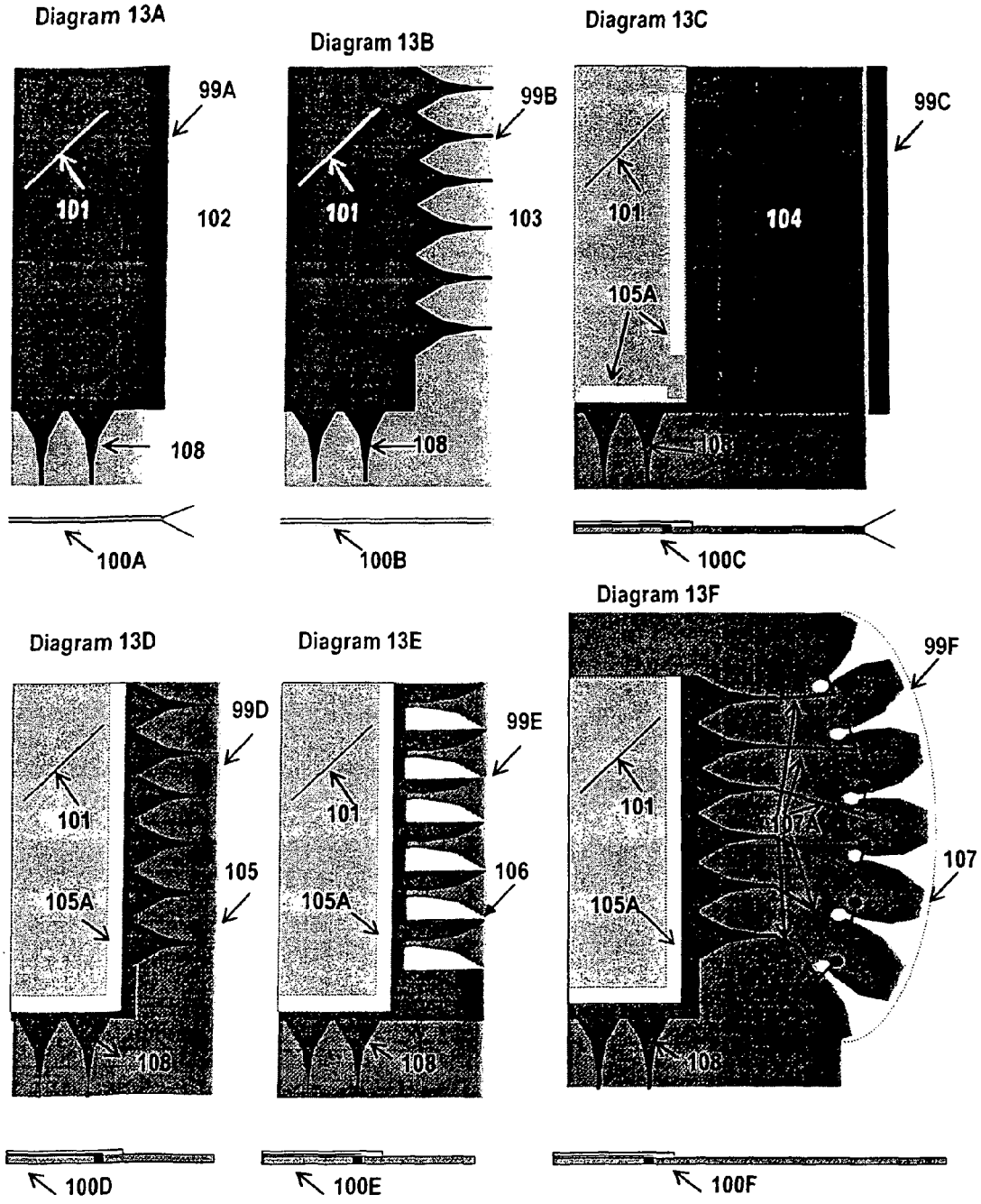
FIG. 13 shows six different instances of an electronically selectable, linearly displaced, diagonal feed, positioned within a rectangular parallel plate configuration, four of which utilise a supporting printed circuit board which incorporates a simple parallel plate transition region.

A number of parallel plate displaced feed configurations are possible and FIG. 13 illustrates six representative case variations in Diagram 13A to 13F, in plan 99A, 99B, 99C, 99D, 99E and 99F and cross-section 100A, 100B, 100C, 100D, 100E and 100F. Configurations A and B are single layer parallel plate structures and configurations C to F are double layer parallel plate structures where the bottom layer is a radio frequency print circuit board structure. Each configuration will now be described separately.

Diagram 13A shows in plan and cross-section, 99A and 100A, a parallel plate feed with a selectable diagonal reflector 101, which operates in the way already described for FIG. 12, except the parabolic launch is now achieved using a pair of flared transitions 108 in the upper parallel plate (e.g. metallization layer), which transit from micro-strip line into parallel plate and vice versa. It is noted that by feeding the pair via a quadrature hybrid (not shown) sum and difference signals may be produced, for example, to provide monopulse operation. A simple flared extrusion 102 is used to transit into free space.

Diagram 13B shows in plan and cross-section, 99B and 100B, a parallel plate feed with a selectable diagonal reflector 101, which operates in essentially the same way as configuration A, except the simple flared extrusion has been replaced by a 'transition out' of the parallel plate which is now essentially the same as the 'transition in'. That is the top layer of the parallel plate flares down into six micro-strip lines. The six micro-strip lines might for example go on to feed a six element patch array.

Diagram 13C, shows in plan and cross-section, 99C and 100C, a parallel plate feed with a selectable diagonal reflector 101, which operates essentially in the way already described for configuration A, except that the system has been split into two layers of parallel plate. The upper layer of parallel plate contains the displaced, selectable diagonal feed and the bottom layer contains inward and outward transitions as previously described. Between the upper and lower parallel plate waveguides is a simple rectangular gap transition, not unlike the U-turn configuration already described, (see FIG. 7), except the wavefront continues in the same direction. To prevent the signal splitting in the lower parallel plate guide, a wall of closely spaced conducting vias, (i.e. via spacing<<half wavelength), can be introduced as an alternative to a continuous metal wall. The top parallel plate may be terminated in the same way. This type of configuration has the advantage that the bottom parallel plate may, for example, be made of cheaper lower loss material, (e.g. microwave printed circuit board material), than more complex, active, upper parallel plate which may for example made of processed silicon. Under these circumstances, the radio frequency printed circuit board material will act as a support of the more fragile silicon.

Diagram 13D, shows in plan and cross-section, 99D and 100D, a parallel plate feed with a selectable diagonal reflector 101, which operates essentially in the way already described for configuration B, except that the system has been split into two layers of parallel plate. The transition between the two parallel plates 105A is as described for configuration C and the same constructional advantages of configuration C also apply to configuration D. It will be noted that the micro-strip lines entering leaving the configuration can be routed as required and might for example route to patches directly on the radio frequency printed circuit board.

Diagram 13E shows in plan and cross-section, 99E and 100E, a parallel plate feed with a selectable diagonal reflector 101, which operates essentially in the way already described for configuration D, except the micro-strip transitions out have been replaced by an array of Vivaldi elements, where the opposite sections of each horn are positioned on alternate sides of the parallel plate, which is readily achieved using the normal printing processes associated with radio frequency printed circuit board manufacture. That is, the vertical electric field between the parallel plates, which are by necessity closely spaced (<<half wavelength apart) is translated (i.e. gradually twisted) to lie between the opposite edges of the Vivaldi horn and so becomes orthogonally polarised to the field between the parallel plates.

Diagram 13F shows in plan and cross-section, 99F and 100F, a parallel plate feed with a selectable diagonal reflector 101, which operates essentially in the way already described for configuration D, except the micro-strip lines 107A, have been continued to feed a curved array of printed Vivaldi elements.

Figure 14:
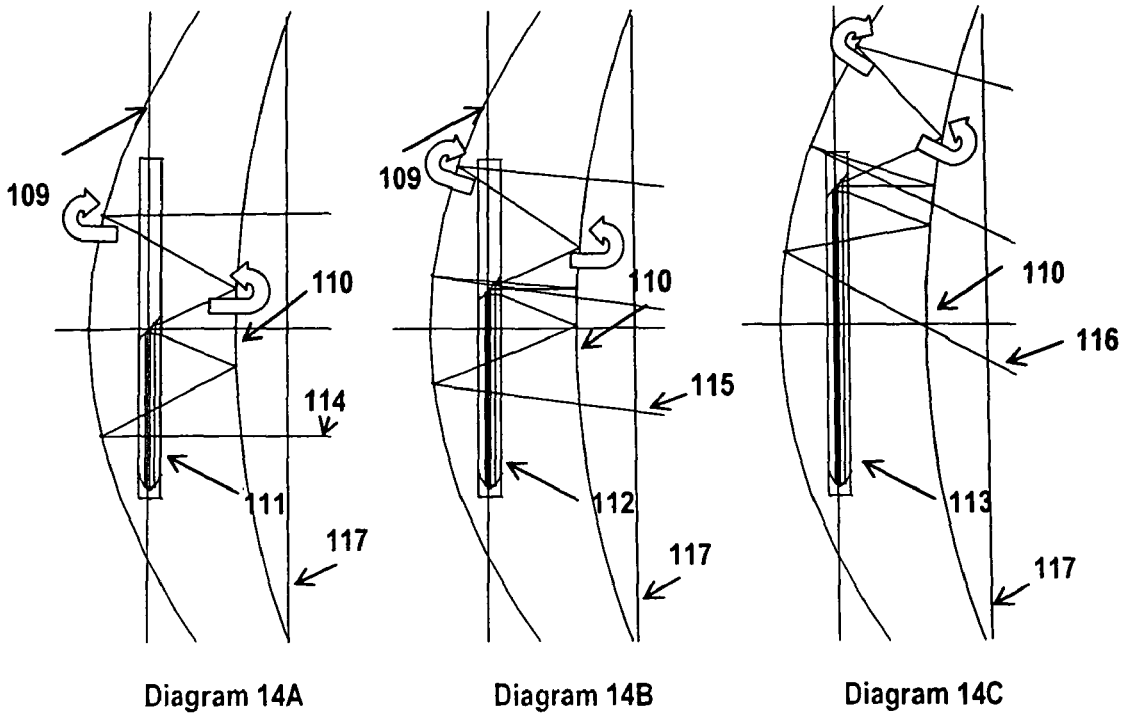
FIG. 14 shows a doubly folded parallel plate antenna employing a linearly displaced, diagonal feed.

FIG. 14 illustrates three instances Diagrams 14A, 14B and 14C of a doubly folded parallel plate antenna employing a selectable diagonal feed, where, for the purpose of example, the diagonal reflector has been set to three different displacements 111, 112 and 113, resulting in three different beam positions 114, 115 and 116. The selectable diagonal feed operates in the same manner as previously described for FIG. 12 and has been positioned within the upper parallel plate section of the antenna configuration such that when reflected by the first parabolic U-turn transition 110, a virtual focus is created at the focus of the second parabolic U-turn transition 109 which is in the lower parallel plate. The U-turn mechanism was previously described in the paragraph relating to FIG. 7. To achieve a thin design layout, both parabolic reflectors are of relatively long focal length. The resultant collimated beam exits into free space via a transition 117, which could for example be a flared horn or Vivaldi elements, (not shown). Although the folded Cassegrain geometry is well known, (especially when it uses twist reflectors and polarising grids to minimise blockage and reduce its depth), its translation into a doubly folded parallel plate design, with an integrated displaced feed, has not been reported. The design can also be adapted to provide multiple simultaneous beams by replacing the displaced feed with an array of launch elements along the focal arc/line of the antenna configuration. Due to the doubly folded configuration still being relatively thin, it may be stacked to form a larger elevation aperture, with optional phase/time delay control providing beam steering in elevation. Further ways of creating fixed and controllable elevation apertures will be returned to later in the description of preferred embodiments.

Figure 15:
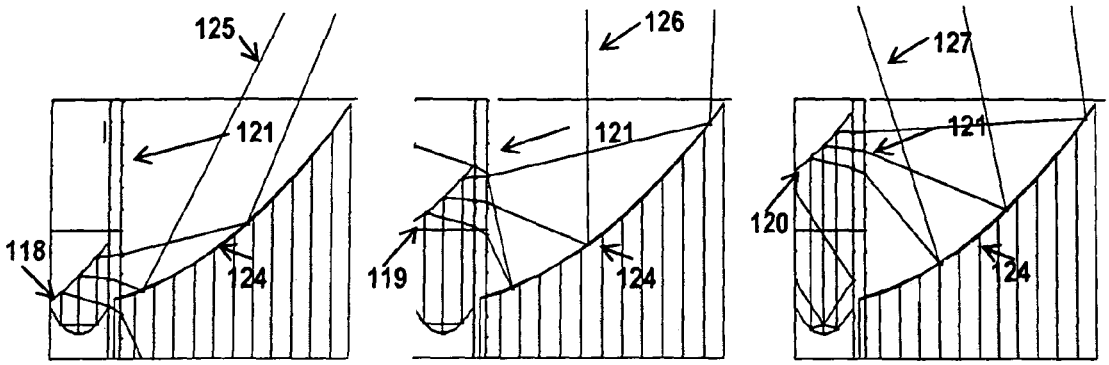
FIG. 15 shows a parallel plate antenna employing an embedded, diagonally displaced feed operating along the principle axis of a parabolic reflector.

By way of further illustration of a selectable, displaced feed configuration, FIG. 15 shows three instances, Diagrams 15A, 15B and 15C, for three differently set displaced feeds, 118, 119 and 120. The selectable displaced feed mechanism is as described for FIG. 12 and launches towards a 'tightly closed' parabolic reflector of relatively short focal length that has a focal line along its focal axis. By slightly curving the diagonal reflector and adjusting the diagonal angle slightly away from 45°, the main reflector 124 may be optimally illuminated. At the main reflector, an optional U-turn transition may be made to prevent the selectable displaced feed causing some blockage at certain beam angles, as illustrated by diagram 15B, where a ray re-enters the selectable displaced feed through transition 121. For the case shown the emerging rays 125, 126 and 127 provide a −10° to 30° field of view. By placing main reflectors to the left and right of the central selectable displaced feed and allowing the selectable reflector to point to both the left and right this field of view may be extended to ±30° at the expense of doubling the aperture. The advantage is that the most complex and expensive item has not been duplicated. It has only been made slightly more complex. A potential advantage of the selectable displaced feed, so described, quickly transits into air filled parallel plate which at higher frequencies (e.g. >50 GHz) will normally outperform low loss dielectrics, such as intrinsic silicon, sapphire and diamond. It is also much cheaper.

Figure 16:
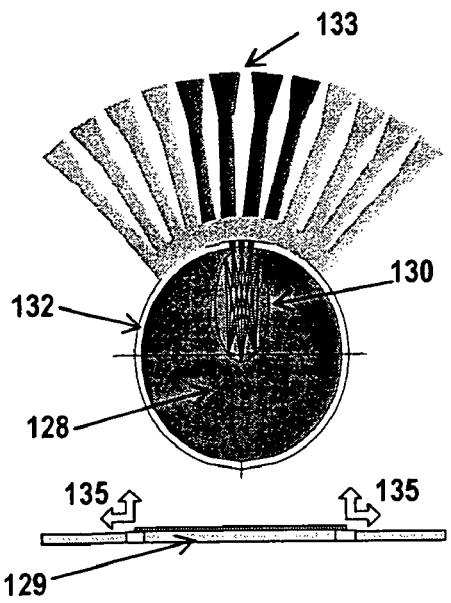
FIG. 16 shows an elliptical commutating device, utilising a parallel plate to parallel plate transition prior to distribution into radial micro-strip lines, used to route radio frequency signals to displaced feeds for doubly curved reflectors.
Figure 16:
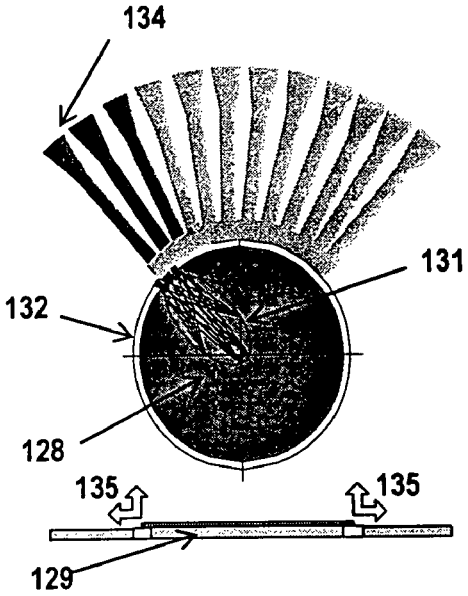

FIG. 16 shows two instances, Diagrams 16A and 16B, in plan and cross-sectional views, of a one-to-many commutating device, employing a centre fed, selectable, elliptical reflector 130 and 131, within an upper, circular parallel plate 128, which transits through a toroidal gap 132, into a lower parallel plate 129 via what is, essentially, a step transition 135. The lower parallel plate acts as a support for the circular upper parallel plate, which is likely to be made of a thin, crystalline material, such as silicon, (to allow PIN diode or micro-electromechanical devices to be formed), which may be liable to cleavage or other fracture if not supported properly. The lower parallel plate, having established a stable E-field between its plate, after the toroidal gap 132 of the step transition 135, transits into radial micro-strip lines which selectively route the applied signal to appropriate groups of launches into free space 133 and 134, here shown as flares that could either return to parallel plate and suitable bi-frustral flare outs or half wavelength patches feed doubly curved reflectors (to be further discussed in the context of FIG. 18, see below). It will be noted that there is an implicit complex weighting (i.e. amplitude and phase) applied across the selected radial lines. In most circumstances, this weighting is advantageous in that it is highest in amplitude at the centre lines and slowly retards in phase/time delay as the lines disperse from the centre position.

This type of configuration is highly suited to circularly symmetric, displaced feed designs. In direct contrast, to the selectable, linearly displaced feed already described in the context of FIGS. 12, 13, 14 and 15, the circular commutator is more compact and therefore has reduced dielectric losses. Moreover, due to its smaller footprint it has the potential to be cheaper than equivalent linear designs. However, one potential limitation is the bandwidth of the circular commutating device, which may not be as broad as the linear commutating device, due to its centre feed which is tightly coupled in its design to the selectable elliptical reflector. In contrast, the linear commutator form of displaced feed is a more collimated design and can utilise broadband Vivaldi horns to launch into its rectangular parallel plate structure.

Figure 17:
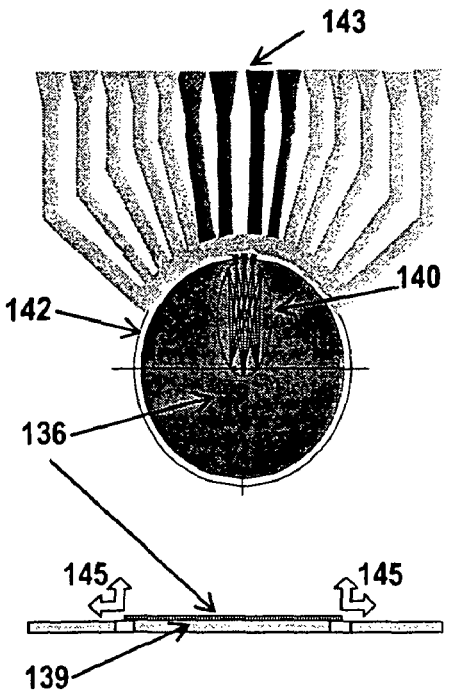
FIG. 17 shows an elliptical commutating device, utilising a parallel plate to parallel plate transition prior to distribution into micro-strip lines, used to route radio frequency signals to displaced feeds for singularly curved reflectors, embedded within parallel plates.
Figure 17:
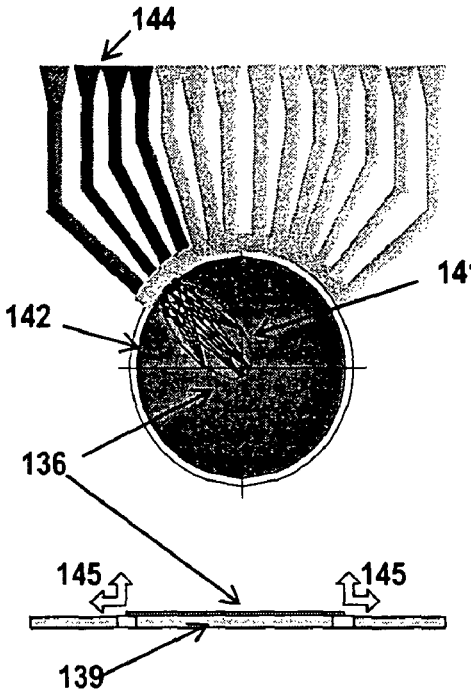

FIG. 17 shows two instances, Diagrams 17A and 17B, in plan and cross-sectional views, of a one-to-many commutating device, employing a centre fed, selectable, elliptical reflector 140 and 141, within an upper, circular parallel plate 128, which transits through a toroidal gap 142, into a lower parallel plate 139 via what is, essentially, a step transition 145. The lower parallel plate transits into radial micro-strip lines which selectively route the applied signal to appropriate linear groups of launches into free space 143 and 144, here shown as flares that could return to parallel plate configurations, such as those shown in less detail in FIG. 3 and FIG. 8. It will be noted that there is an implicit complex weighting (i.e. amplitude and phase) applied across the selected radial lines. In most circumstances, this weighting is advantageous in that it is highest in amplitude at the centre lines and slowly retards in phase/time delay as the lines disperse from the centre position. Thus, FIG. 17 is in most regards the same as FIG. 16, except the micro-strip lines form a linear rather than a curved array. The different transit times along these different length lines may require equalisation (i.e. extra line length) if the ellipse becomes too open or if lines are routed out from the circular commutator through a full 360°. However provided the relative delays remain within a small fraction of wavelength (e.g. <5°, say, at the maximum operating frequency, between adjacent tracks), this should not be necessary.

Figure 18:
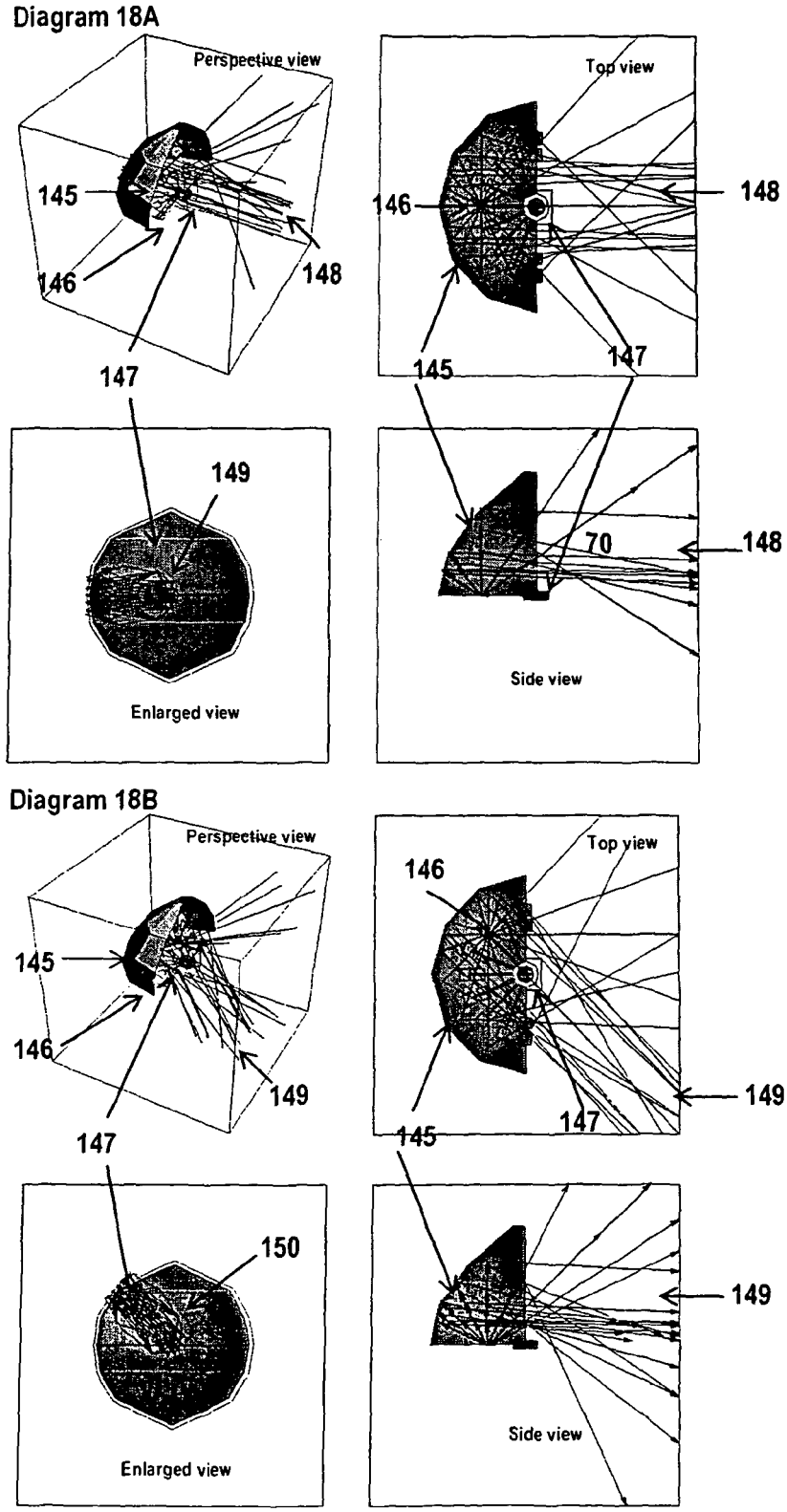
FIG. 18 shows a closed parabolic surface of revolution reflector utilising a parallel plate elliptical commutating device as shown in FIG. 16 to achieve routing to displaced feeds.

FIG. 18 illustrates, for a centre beam and an offset beam, Diagrams 18A and 18B, a parabolic surface of revolution 145, fed via a circular array of angularly displaced, corporately fed, double patches 146, selected through an elliptical, parallel plate commutator 147. For clarity, perspective, top and side views are shown, together with an enlarged view of the elliptical, parallel plate commutator. For the two angular displacements of the ellipse 149 and 150, two collimated beam positions 148 and 149 result. The circular patch array, its selection lines and its parallel plate interface can be integrated on single radio frequency printed circuit board, as described previously for FIG. 16. This simplifies construction considerably. In order to maximise the radio frequency energy directed at the parabolic surface of revolution and minimise spill-over, the two radial patches may be phased or time delayed, within the corporate feed transmission lines, to tilt backwards toward the parabolic surface of revolution.

Figure 19:
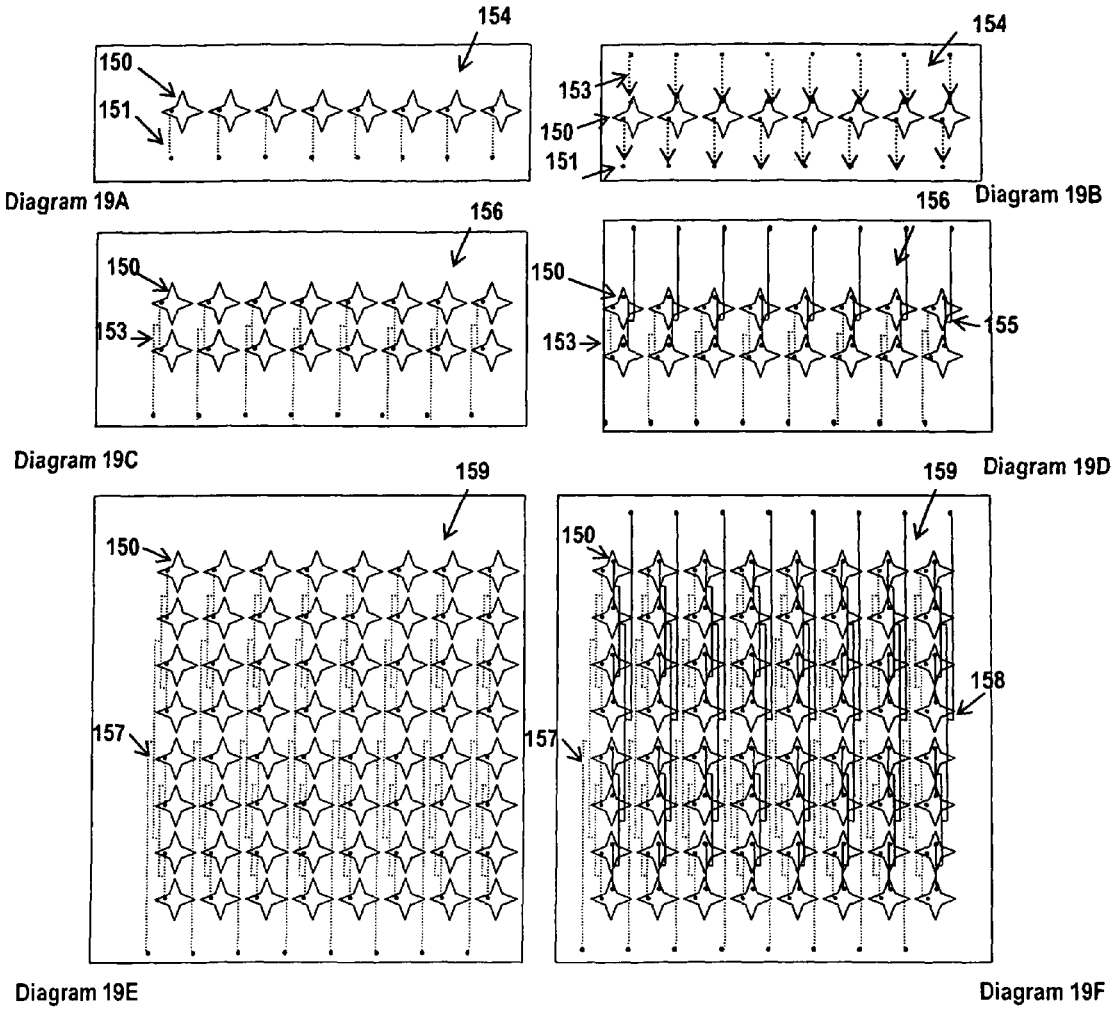
FIG. 19 shows instances of a linear, a doubly linear and a square array of patch elements, in vertical and dual polarised forms, suitable for controlled launches into free space and integration with parallel plate displaced feed beamformers.

FIG. 19 illustrates six instances, Diagrams 19A to 19F, of a planar array of printed patches, for a linear array (i.e. n by 1 elements), a dual linear array (n by 2 elements) and a square array (n by n elements), for single and dual polarisation feeds, where 'n' is set to 8, for illustration purposes only. It is intended that such arrays will form a highly compact transition into free space for the parallel plate beam-forming systems previously described.

Diagram 19A shows the simplest case, where 8 star elements 150, arrayed in a line, and fed individually via micro-strip lines 151 connected via a metal pin through holes in a common centre ground plane 152, (set between the elements and the micro-strip lines), to close to one of the corners of the horizontal arm of the star elements, to so provide a vertically polarized electromagnetic wave. A horizontally polarised electromagnetic wave may be generated by connecting to close to one of the corners of vertical arm of the star element. Diagram 19B shows a dual polarised linear array of 8 elements with both vertical and horizontal arms connected to micro-strip lines 151 and 152. By phasing and switching the signals arriving through the micro-strip lines connect to both the horizontal and vertical arms of the star shaped element, vertical, horizontal, diagonal and circularly polarised electromagnetic waves may be generated.

Diagrams 19C and 19D illustrate the dual linear array, for vertical and dual polarisation feeds respectively. Descriptions for both cases are as given above for Diagrams 19A and 19B, except a two way micro-strip corporate feed 153, has been introduced for the vertically polarised case, and a similar corporate feed 155, to provide the horizontal component of the dual polarised system. The slightly larger ground plane 156 is as described previously for 19A and 19B.

Diagrams 19E and 19F illustrate a planar 8×8 array, for vertical and dual polarisation feeds respectively. Descriptions for both cases are as given above for Diagrams 19C and 19D, except an eight way micro-strip corporate feed 157, has been introduced for the vertically polarised case, and a similar corporate feed 158, to provide the horizontal component of the dual polarized system. The square ground plane 159 is as described previously for Diagrams 19C and 19D.

It is here noted that star shaped array elements have been chosen for illustrative purposes only and may be replaced by a wide variety of printed shapes, such as squares, crosses and diamonds, which can be coupled into directly via metal pins or indirectly via driven slots, fed through printed or wave guiding structures. Such distribution networks may, for narrow band systems, be linear tapped delay lines or as illustrated for wideband systems, corporate feeds. The single and dual polarisation elements may be replaced, for example, by single and crossed Vivaldi elements, slots, horns and quad-ridge horns.

To illustrate, by way of example only, how planar, thin displaced feed antennas may be configured as single and dual polarized systems four different configurations will be described, using parallel plate, displaced feed beamformers previously explained.

Figure 20:
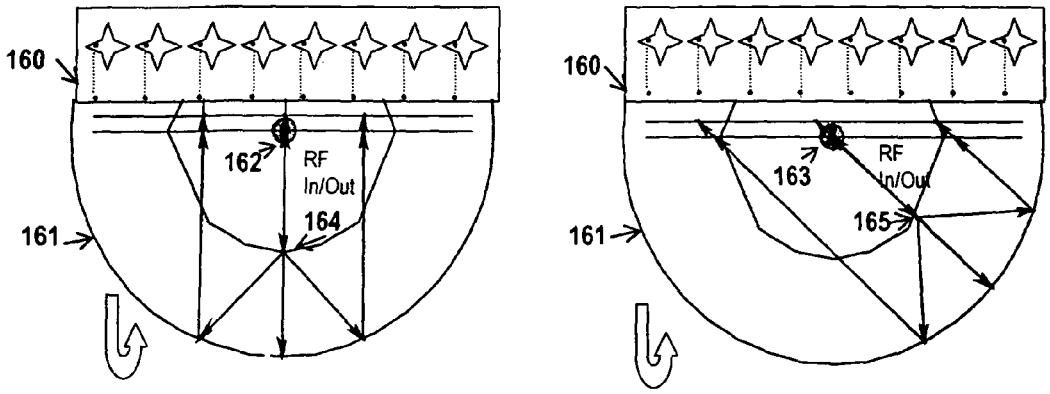
FIG. 20 shows a linear array of vertically polarised elements fed via a displaced feed, parallel plate beamformer utilising a circular feed and reflector configuration.

FIG. 20 shows, for central and offset pointing positions Diagrams 20A and 20B, a vertically polarised, displaced feed antenna, employing a linear array of elements 160 directly connected to the folded parallel plate beamformer 161, already been described for FIG. 4, via an array of discrete micro-strip-to-parallel plate transitions. As previously explained, the antenna is fed by an elliptical commutating device (see FIG. 16 and associated text) which is shown for two positions 162 and 163 in diagrams 20A and 20B that illustrate a centre launch 164 and an angularly displaced launch 165 respectively. By way of example only, the micro-strip-to-parallel plate transitions might be implemented by dividing the thin vertical aperture of the parallel plate into approximately half wavelength slots and use vertical field probes, appropriately positioned within the slots to maximise signal levels, connected through holes in the ground plane to directly feed the micro-strip lines of the linear array 160. This is one of many possible connector-less transitions, particularly appropriate when the parallel plate dielectric is air and low cost implementation is a prime driver.

Figure 21:
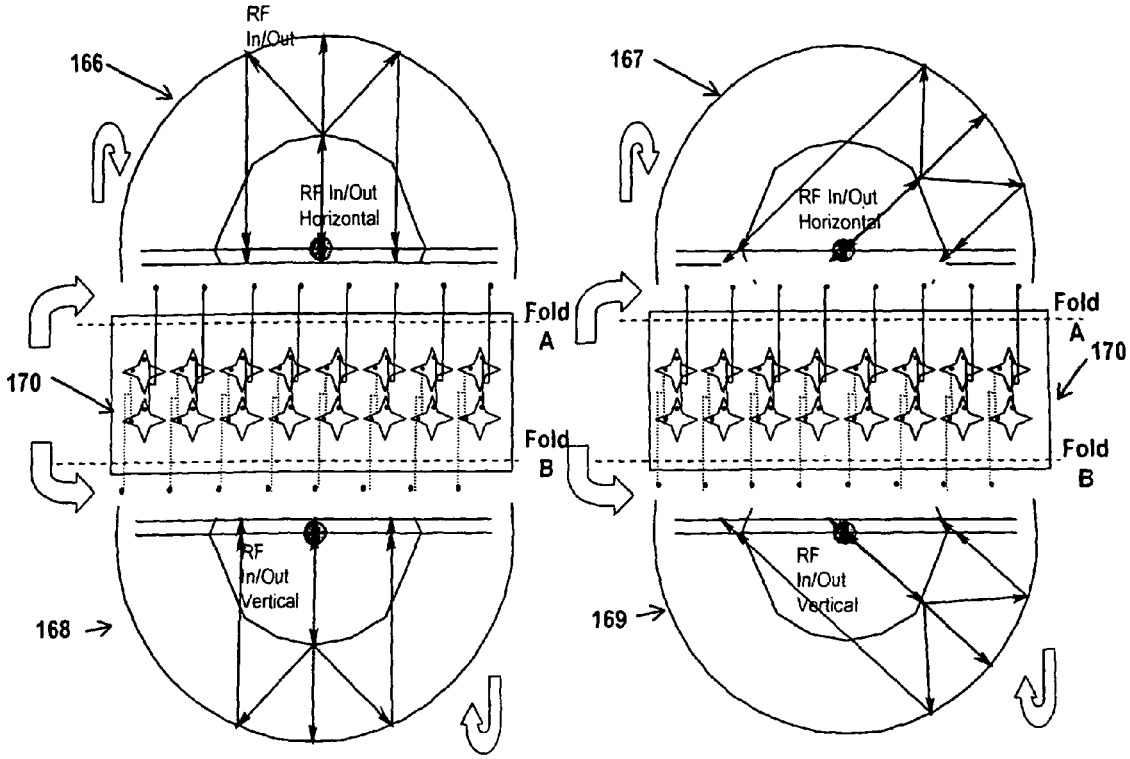
FIG. 21 shows a doubly linear array of dual polarised elements fed via two independent displaced feed, parallel plate beamformer utilising a circular feed and reflector configurations.

FIG. 21 shows in 'unfolded' form, for central and offset beam pointing positions (Diagrams 21A and 21B), a dual polarised, displaced feed antenna, employing a dual polarised, dual linear array of elements 170, directly connected to two independent beamformers, separately supporting both horizontal and vertical polarizations, which are shown for centre 166 and 168 and offset 167 and 169 positions. The two beamformers connect to the array face via two arrays of discrete micro-strip-to-parallel plate right angle transitions positioned at Fold A and Fold B. Since the array and the beamformer are perpendicular, due to the Folds A and B, the micro-strip-to-parallel plate transitions might be implemented by dividing the thin vertical aperture of the parallel plate beamformers into approximately half wavelength slots and then using the ends of the printed micro-strip lines as vertical field probes, appropriately positioned within the slots to maximise signal levels. This is one of many possible connectorless right angle transitions, particularly appropriate when the parallel plate dielectric is air and low cost implementation is a prime driver.

Figure 22:
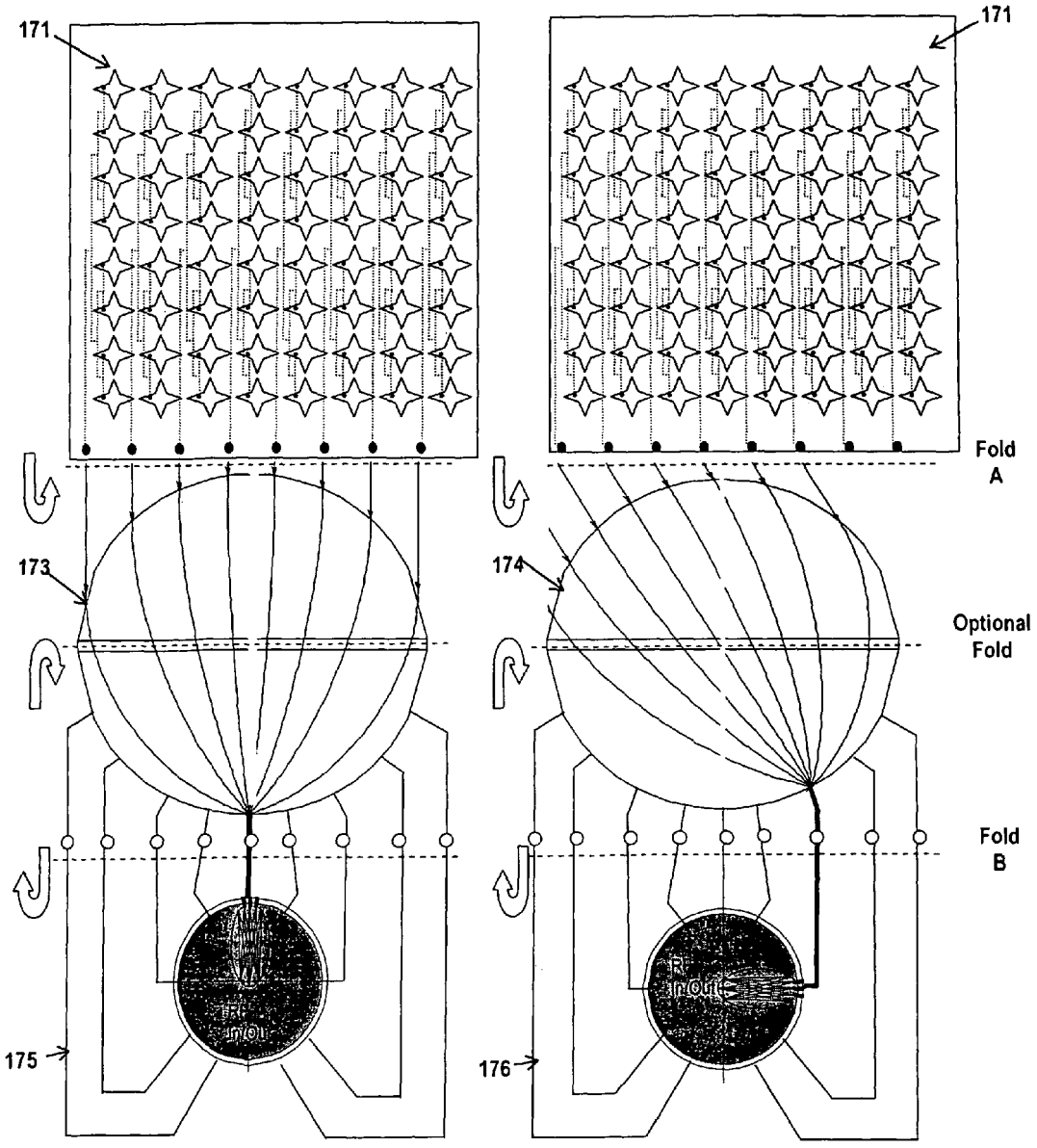
FIG. 22 shows a square array of vertically polarised elements fed via a displaced feed parallel plate beamformer utilising a parallel plate, Luneburg lens, displaced feed beamformer.

FIG. 22 shows in 'unfolded' form, for central and offset beam pointing positions (Diagrams 22A and 22B), a singularly polarised, displaced feed antenna, employing a vertically polarised, square array of elements, 171, directly connected to a single flat Luneburg lens beamformer, which is shown for centre 173 and offset 174 feed positions, fed by an elliptical commutating device, shown in two associated positions 175 and 176. It will be noted that the entire circumference of the elliptical commutator has been used to achieve a ±45° scan. By the use of U-turn parallel plate-to-micro-strip line transitions, at Folds A and B, the entire assembly may be compacted into a multilayer form, where the horizontal and vertical dimensions of the assembly are approximately those of the array face. It will be seen that the fold in the flat Luneburg lens system is optional, as generally there will be enough space behind the array face to accommodate the full lens.

Figure 23:
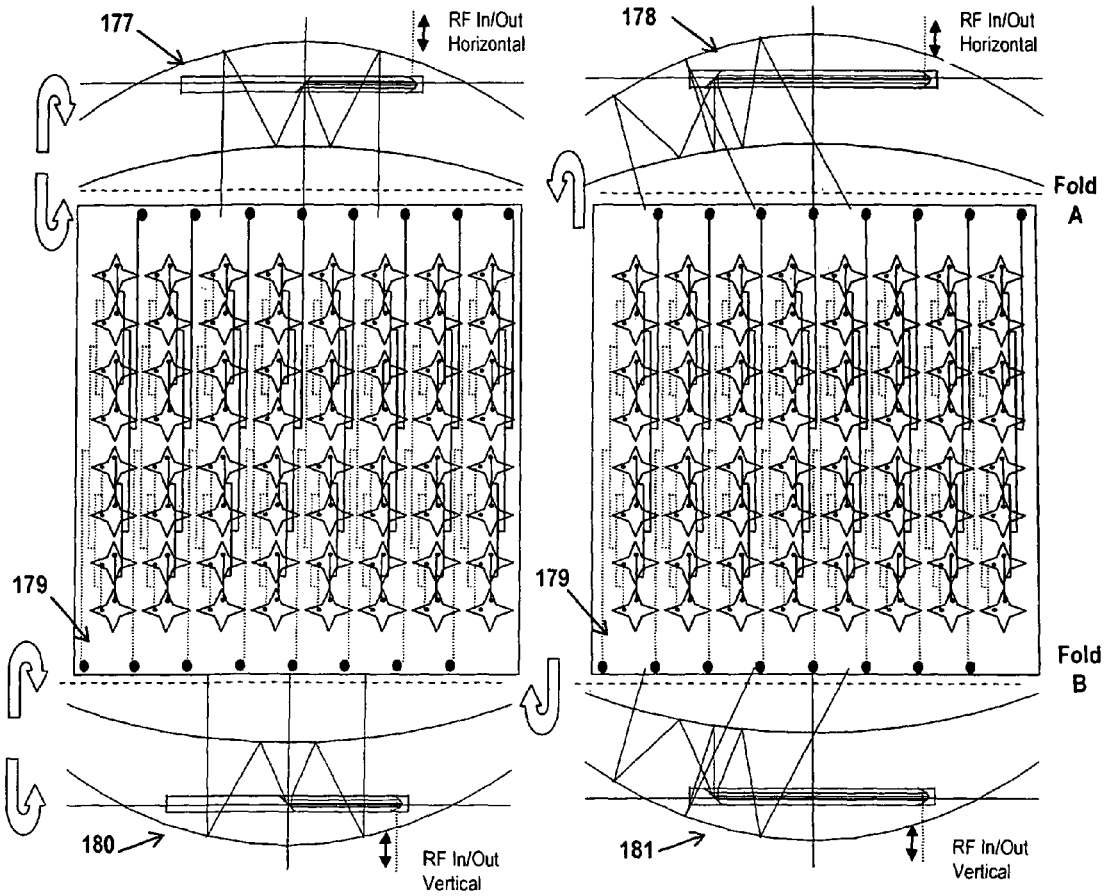
FIG. 23 shows a square array of dual polarized elements fed via two doubly folded, parallel plate beamformers, employing a linearly displaced feed.

FIG. 23 shows, in 'unfolded' form, for central and offset beam pointing positions (Diagrams 23A and 23B), a dual polarised, displaced feed antenna, employing a dual polarised, square array of elements 179, directly connected to two independent doubly folded beamformers, previously described in the context of FIG. 14, separately supporting both horizontal and vertical polarizations, which are shown for centre 177 and 180 and two independent offset 178 and 181 positions. The two beamformers connect to the array face via two arrays of discrete micro-strip-to-parallel plate U-turn transitions positioned at Fold A and Fold B. Due to the highly compact form of the beamformers, the two radio frequency in/out ports, for both orthogonal polarizations, meet close together, behind the array face near its centre. This is ideal for polarisation where control of phase and amplitude between the ports permits full polarisation control of the generated beams. It should be noted that, for the set up shown, the horizontally and vertically polarised offset beams are independently pointed in opposite directions, allowing a further degree of freedom in the antenna's operation.

Figure 24:
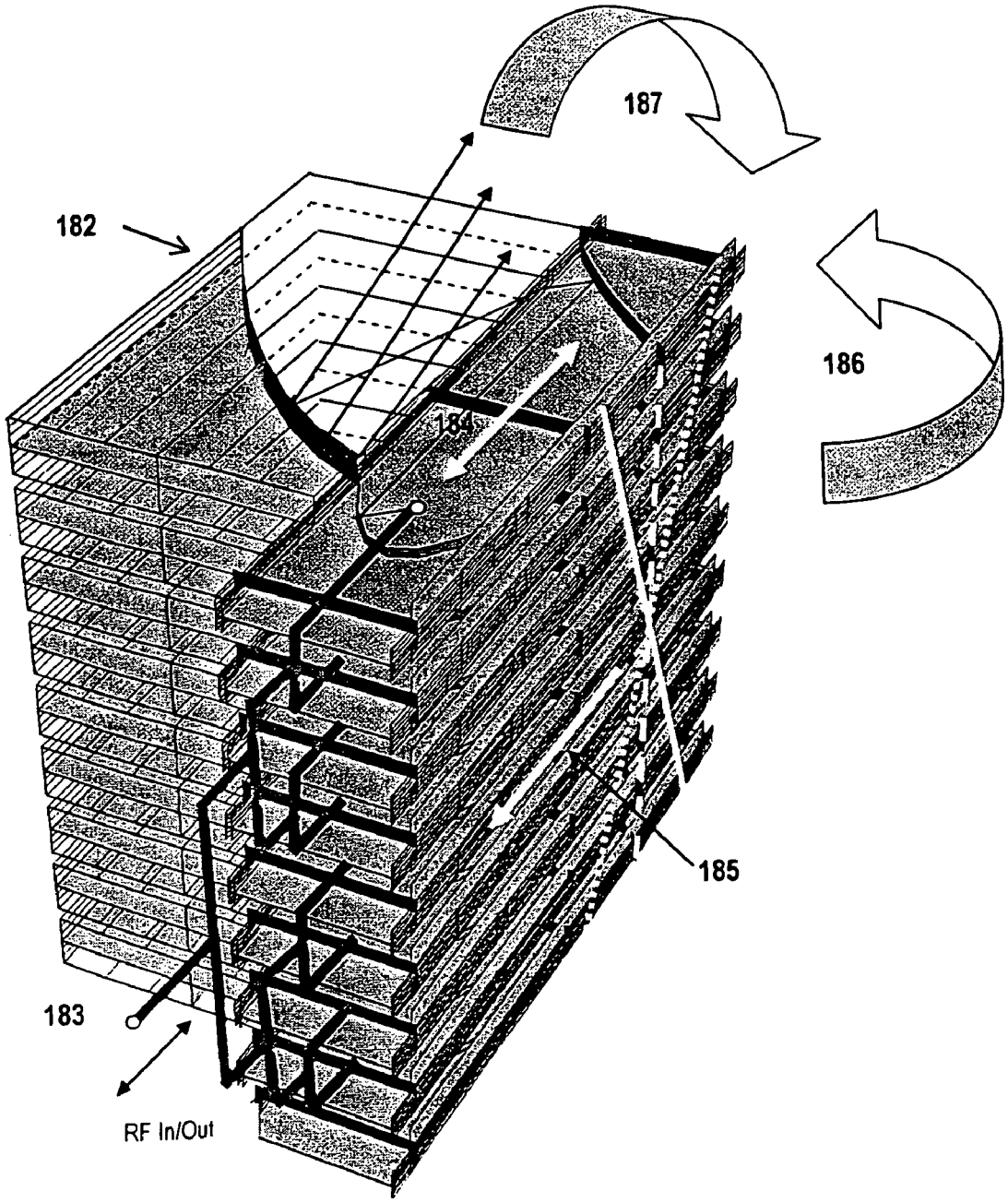
FIG. 24 shows a stack of linearly displaced feed antenna elements, fed via a corporate feed and capable of limited 2D scanning by small increment delay displacements of the vertical stack.

FIG. 24 illustrates how 2D scanning can be achieved, without the use of phase shifters, using a vertical stack of displaced feed antenna modules 182, based on the design already discussed in the context of FIG. 15, fed via a corporate feed network 183. That is, the corporate feed network 183, with its single radio frequency in/out port, ensures each of the antenna modules is equally fed in phase. If each of modules has the same setting of displacement 184, then the resulting horizontal wavefront remains in phase and consequently no elevation steering occurs. However, if each of the antenna modules has a stepped displacement relative to its neighbours in the stack, the resulting horizontal wavefront tilts upwards or downwards according to the sign of the displacement and in this way elevation steering occurs 187. Azimuth steering 186, at any elevation setting is achieved by increasing or decreasing all the set displacements by equal amounts. It will be noted that some axial main beam distortion will occur due the vertical aperture distribution becoming slightly twisted when a set of incremented vertical displacements are demanded to achieve a given elevation beam angle. Fortunately, the azimuth displacements are generally much larger than the elevation displacements, (which are essentially short time delays that need only range over phase equivalent settings of $\pm\pi$, for narrowband beamsteering) and for many cost-driven applications the main beam distortion is likely to be acceptable.

Figure 25:
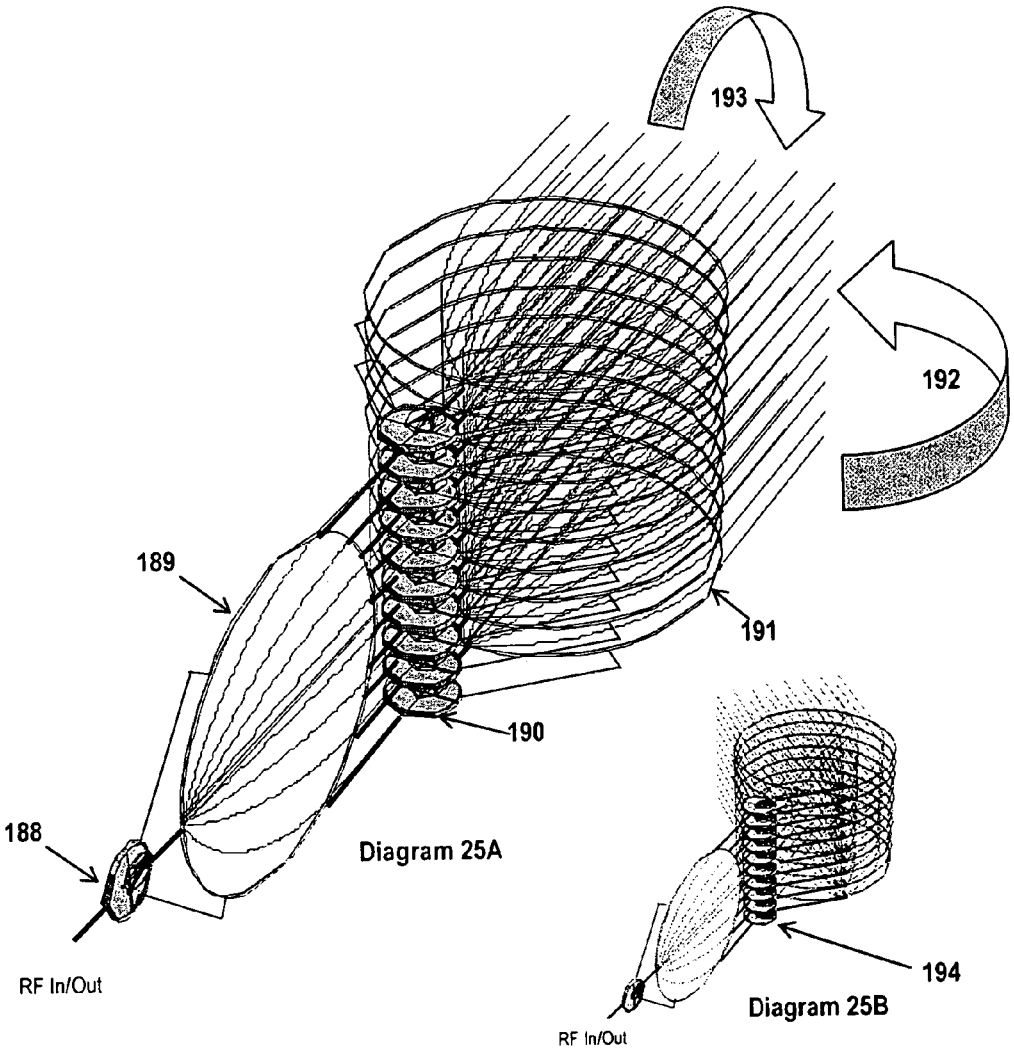
FIG. 25 shows a 2D displaced feed configuration employing a stack of horizontal, parallel plate, displaced feed Luneburg lenses selected via a vertical displaced feed Luneburg lens.

2D scanning can also be implemented in the way shown in FIG. 25. In Diagram 25A, for the transmit case, a signal enters the antenna configuration via an elliptical commutator 188 which in turn feeds a full parallel plate Luneburg lens 189. Micro-strip outputs from the parallel then feed a stack of orthogonal elliptical commutators 190, which in turn feed a similarly orientated stack of parallel plate Luneburg lenses. In Diagram 25A, the signal launches into free space normally. In Diagram 25B, the stack of elliptical commutators, 194, has been adjusted to select a leftward steered beam. In this way an azimuthal scan 192 can be achieved. By adjusting the initial elliptical commutator 188, the beam can be made to scan in elevation 193. In all, if a beamformer element comprises an elliptical commutator 188 and a Luneburg lens 189 and N such units for a vertical stack, only one further such unit is required to perform full 2D steerage in both azimuth and elevation.

Figure 26:
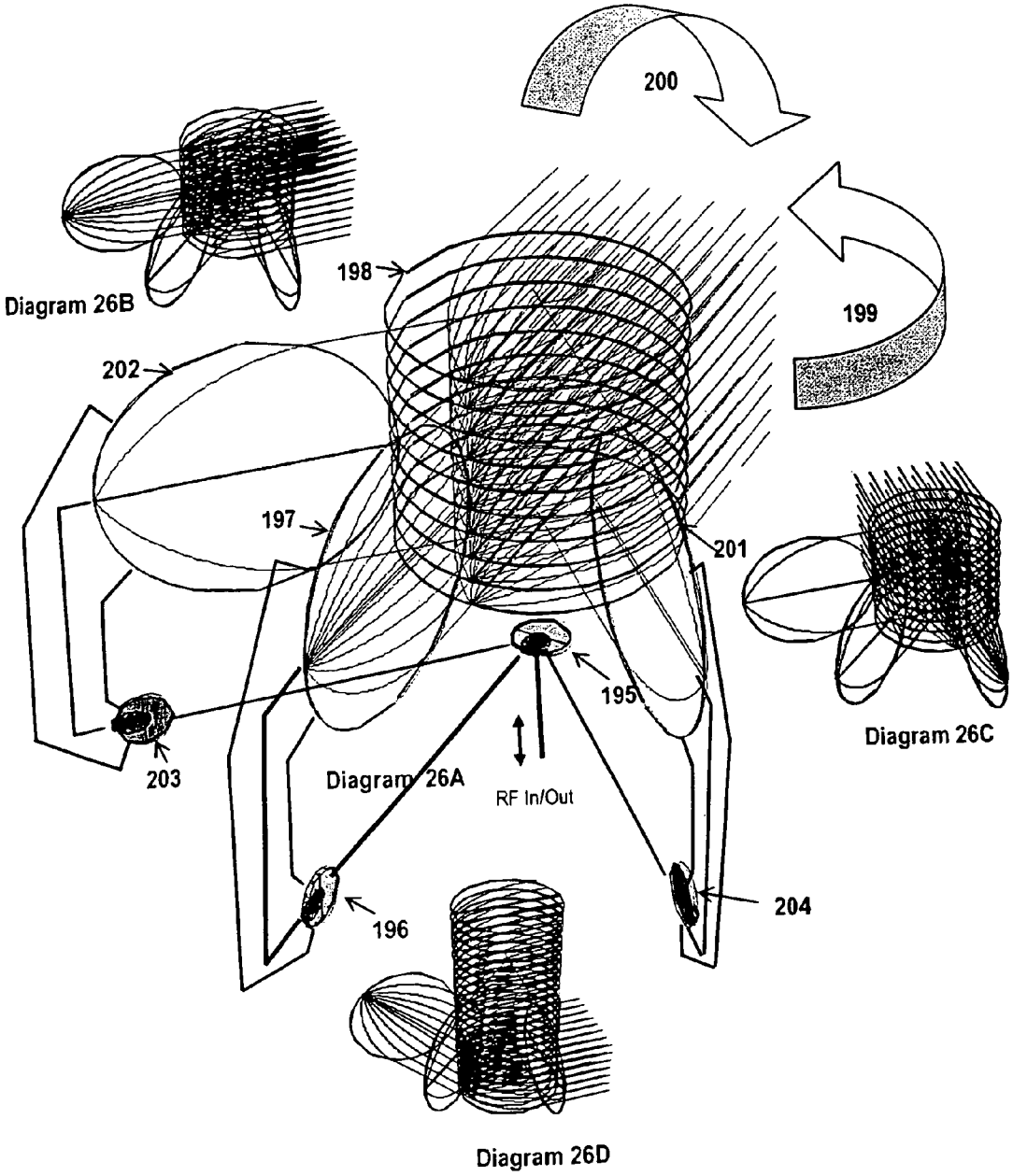
FIG. 26 shows a 2D displaced feed configuration employing a stack of horizontal, parallel plate, displaced feed Luneburg lenses selected via an array of vertical displaced feed Luneburg lenses.

Multi-beam 2D scanning may be implemented using a similar network to that already described for FIG. 25, except more Luneburg lenses need to be used. FIG. 26 shows an example of one such system. In Diagram 26A a signal is routed to one of three elliptical commutators 196, 203 or 204, via an orthogonal elliptical commutator 195. This routing matrix is optional, or may be reduced, dependent on the type multi-beam operation that is sought. From the selected elliptical commutator 196, the signal is routed to one of the selected Luneburg lens's 197 displaced feeds, which in turn feed the stack of Luneburg lenses 198. That is, multiple beams in elevation are always available, and using a selection network, such as 196 or 203 or 204, can be made to scan in elevation 200. Multiple beams in azimuth are realised by adding radial Luneburg lenses in the vertical plane e.g. 202, 197 or 204 and can be made to scan in azimuth 199, using a single elliptical commutator 195. Thus, in this arrangement, if there are N Luneburg lenses in the stack and M vertical beamformers, the number of possible beams is N×M, with M+1 elliptical commutators required to select one azimuth beam, if a single input/output port is required. Diagrams 26B and 26C illustrate azimuth beam selection. Diagram 26D shows elevation scanning using an extended stack of Luneburg lens to make maximum use of the radially feeding, Luneburg lens's vertical output lines. Without this extension, low elevation sidelobes would be generated due to the sharp truncation of the stack's vertical aperture distribution. It should be noted that such multi-beam forming systems are extremely flexible and are potentially very wideband; properties, not easily achieved using conventional phased arrays.

Figure 27:
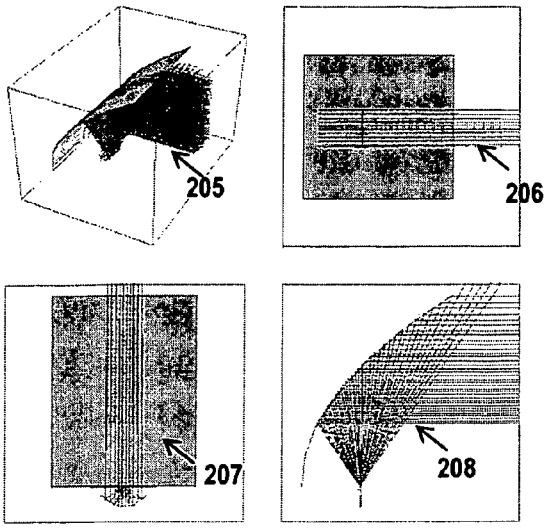
FIG. 27 shows an Azimuth and elevation beam patterns for a parallel plate displaced feed antenna employing undistorted reflectors.
Figure 27:
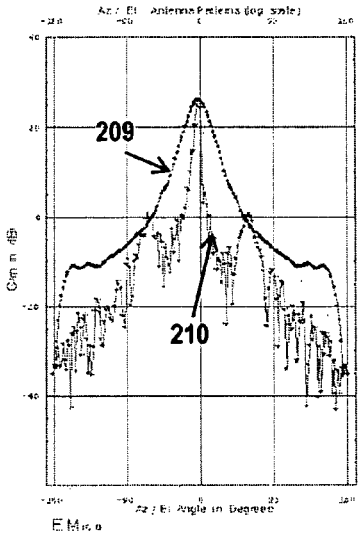
Figure 27:
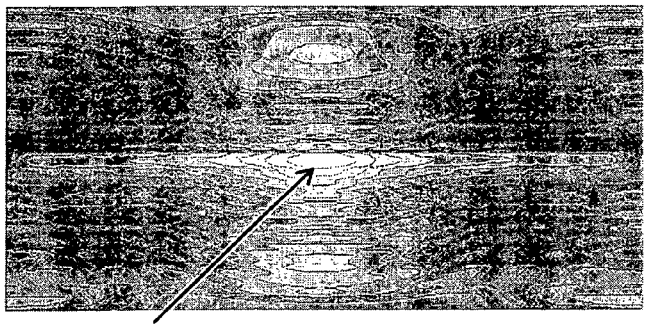
Figure 27:
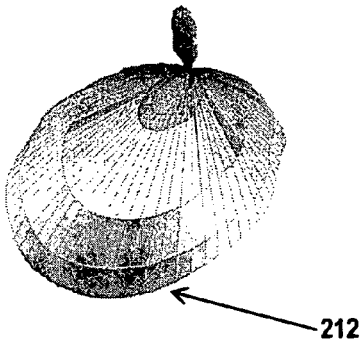
Figure 28:
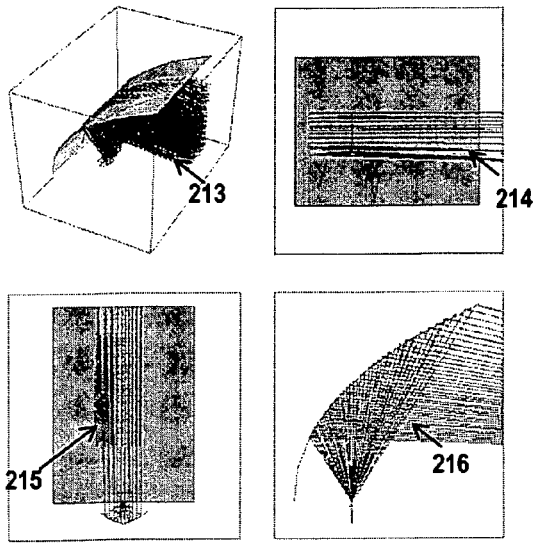
FIG. 28 shows an Azimuth and elevation beam patterns for a parallel plate displaced feed antenna employing distorted reflectors, resulting in approximately cosecant squared patterns.
Figure 28:
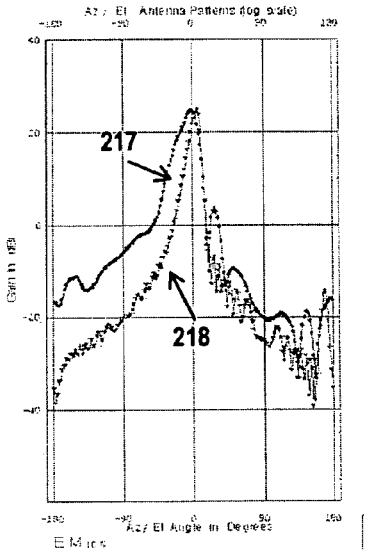
Figure 28:
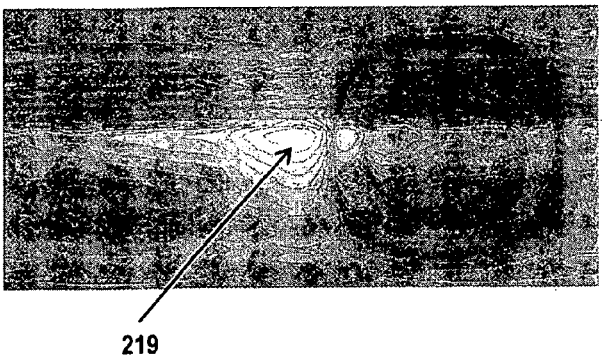
Figure 28:
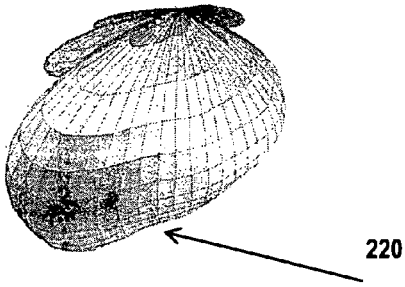

The use of a distorted parabolic reflector fed by a displaced feed beamformer, such as that already described in the context of FIG. 8, allows a wide variety of useful beam shapes to be formed at little, or no, extra complexity or associated cost. FIGS. 27 and 28, contrast the performance of two displaced feed antennas that employ undistorted and distorted reflectors, respectively.

FIG. 27 illustrates the typical performance of an extruded parabola antenna, employing undistorted first and second reflectors, in terms of:

- A ray trace, Diagram 27A,
- Superimposed azimuth and elevation directivity patterns on a decibel scale, Diagram 27B,
- A contour plot in azimuth/elevation on decibel scale, Diagram 27C,
- A 3D log polar representation of directivity, Diagram 27D.

It should be noted from Diagram 27A that the ray trace produces a well collimated beam shown in perspective 205, in top view 206, in front view 207 and side view 208. As to be expected from the ray trace, Diagram 28B shows, for the principle planes, a wide, symmetric azimuth directivity pattern and narrow, slightly asymmetric elevation pattern, due to the offset nature of the feed. Diagrams 27C and 27D confirm no unexpected off-axis sidelobes.

FIG. 28 illustrates the performance of an extruded parabola antenna, employing distorted first and second reflectors, in terms of:

- A ray trace, Diagram 28A,
- Superimposed azimuth and elevation directivity patterns on a decibel scale, Diagram 28B,
- A contour plot in azimuth/elevation on decibel scale, Diagram 28C,
- A 3D log polar representation of directivity, Diagram 28D.

It should be noted from Diagram 28A that the ray trace produces a partially collimated beam shown in perspective 213, in top view 214, in front view 215 and side view 216. As to be expected from the ray trace, Diagram 28B shows, for the principle planes, a wide, asymmetric azimuth directivity pattern 217, due to the distorted asymmetric nature of the first reflector (i.e. the reflector embedded between the parallel plates) and a narrow, highly asymmetric elevation pattern 218, primarily due to the distorted nature of the second reflector (i.e. the extruded parabola). Diagrams 28C and 28D confirm the expected triangular form of the main beam, with no unexpected off-axis sidelobes. The nature of the distortion to the reflectors can be either continuous or piecewise linear. As a simple example, a parallel plate undistorted parabolic reflector has the mathematical representation:

$$Y_{undistorted}=ax^2+c.$$

An asymmetrically distorted, parabolic reflector may be implemented by introducing a third order distortion term, which can be represented by:

$$Y_{distorted}=ax^2+bx^3+c.$$

In general, the undistorted reflector may have a form:

$$F(x,y)=F_{undistorted}(x,y)+F_{distorted}(x,y)$$

Where $F_{undistorted}(x,y)$ and $F_{distorted}(x,y)$ are 2D polynomials defined across the aperture of the antenna. It is important to recognise that for the illustrated example the first and second reflectors to a first approximation may be considered orthogonal and may be independently adjusted to achieve required distortions in the principle planes, with only modest interactions between the azimuth and elevation directivity cuts.

The type of distortion illustrated in Diagram 28C, approximates to a cosecant squared pattern in both azimuth and elevation, which, in practice, is often sought in mobile communication systems to maintain an approximately constant signal level, (i.e. to work within a given dynamic window), as a moving communicator approaches an elevated, fixed communications node along an approximately linear course. An alternative approach to the synthesis of cosecant squared and other shaped beams is to phase and amplitude weight multiple displaced feed.

The invention claimed is:

1. A displaced feed antenna, operating at UHF, microwave, millimeter wave and terahertz frequencies, having a spaced conducting plate construction that incorporates electronically selectable feed points with associated antenna beam positions, which displaced feed antenna comprises:

(i) a set of one or more beamforming configurations composed of layered, interlinking spaced conducting plates and conducting boundaries that are separated by cavities containing dielectric material or free space; in which adjacent layers of the interlinking beamforming configuration of spaced conducting plates are in the form of folded U-turn transitions at the point of reflection and overlapping step transitions at the point of transmission, and in which the step transitions are implemented as controlled gaps in the inner common plates, which, in the case of reflection is directly in front of a conducting reflecting boundary between the outer plates, and in the case of transmission is between conducting reflecting boundaries joining the two outer parallel plates to an inner parallel plate to either side of the overlap created by the gap; in which adjacent layers between the spaced conducting plates are filled with either the same or different dielectrics and contain refractive components to aid electromagnetic collimation or focusing; and in which the conducting and reflecting boundaries are contoured and spaced to provide good radio frequency matches between dielectrics of different dielectric constants and thicknesses;

(ii) a set of one or more internal focusing means for each beamforming configuration to route radio frequency energy to or from the displaced feed points in receive and transmit modes respectively;

(iii) a linear or curved array of displaced feeds which are for each beamforming configuration and which are in the form of reciprocal transitions between radio frequency transmission lines or waveguides for coupling radio frequency energy into, or from, the cavity between the plates;

(iv) a selection means to allow definable overlapping regions of the focussing means to be illuminated for each beamforming configuration, by routing radio frequency energy to create a displaced feed, controllable in extent and position, within the array of displaced feeds; and (v) a radio frequency transition means for each beamforming configuration between spaced conducting plates to free space, allowing either single polarisations or dual polarisation operation.

2. A displaced feed antenna according to claim 1 and including:

(vi) an external focusing means to work in conjunction with the internal focusing means to route incoming or outgoing energy to or from the displaced feed points in receive and transmit modes respectively.

3. A displaced feed antenna according to claim 2 in which the external focusing means is reflective extrusion or a reflective surface of revolution to allow further control of beamwidth and sidelobe levels, where the cross sectional shape may also allow asymmetric beam shape weightings; in which the internal focusing means to route radio frequency energy to or from the displaced feed points on receive and transmit, respectively, is either a reflecting or refracting transition in the form of a U-turn or step transition or a graded index change in inter-plate dielectric, respectively, or some combination thereof, and following either a linear, parabolic, a circular boundary or some suitable variation or distortion thereof, to result in either a collimated, partially collimated or a focused beam at the transition from the spaced conducting plate to free space; and in which the internal focusing means is a flat Luneberg lens of graded reflective index embedded within a centrally folded parallel plate structure.

4. A displaced feed antenna according to claim 3 and including an embedded reflector where a small displacement of the feed results in large displacement of the focus, due to the displaced feeds having been moved away from the reflector's focal arc and an optical magnification effect having been introduced; and in which the transition between the spaced conducting plates and free space are either steps, U-turns or right angles and connect to appropriately oriented linear or curved array of launch elements, in the form of a linear flared horn, linear array of patches, a linear array of printed horn structures, a curved flared horn, a curved array of printed patches or curved array of printed horns, and in which the launch elements either transit directly from the parallel plate or via linear, radial or curved transmission lines, such as micro-strip or coplanar lines.

5. A displaced feed antenna according to claim 4 in which the spaced conducting plates share a single common ground plane with the printed transmission lines and launch elements; in which the launch elements are so coupled by slots or connected by metal pins through linear, tapped delay lines (or waveguides) or corporately fed structures to provide a range of polarisations; and in which the launch elements have orthogonal polarisation inputs and their feeding structures can be fed by either single or multiple, spaced conducting plate, beamforming systems, to allow either all polarisations to be formed when their radio frequency ports are phase and amplitude weighted or provide independent multiple beam operation using opposite polarisations.

6. A displaced feed antenna according to claim 4 in which the U-turn and right angle transitions are introduced to interface correctly to the launch elements but also to achieve the desired trade-offs between x, y and z dimensions of the assembled antenna configuration, in which the right angle transition to an array of printed patches is implemented as a radio frequency printed circuit board, with printed lines, feeding the patches, spaced at less than half wavelength and placed directly in front of half wavelength slots that are positioned between an edge of the spaced conducting plates, so providing an efficient right angle transition without the use of right angle connectors; and in which the corporate feed to the antenna elements has incrementally added line lengths to steer the beam away from boresight in order to reduce spillover if there is a reflector present or allow flat to the wall mounting when the elevation beam is required to point upwards.

7. A displaced feed antenna according to claim 1 and including:

(vii) a selection and combining network means to allow the beamforming configurations to be arrayed and perform single and multi-beam 2D scanning.

8. A displaced feed antenna according to claim 7 in which the relative lengths of the transmission paths between the selection means and the displaced feed are designed to provide controllable time delays to steer the beam in the orthogonal dimension; and in which the selection means is able to selectively provide phase shifts, time delays and variable attenuation capabilities, as required, to improve the sidelobe performance of the displaced feed antenna.

9. A displaced feed antenna according to claim 7 in which external focusing means are arranged such that the linear or curved array of launch elements are along the focal lines and arcs of either a singly or a doubly curved reflecting surface to so produce a collimated or partially collimated beam in a direction related directly to the displaced feed's or group of adjacent feeds' linear or angular positions; and including external singularly curved 'parabolic' reflector, where a third order 'distortion' term has been introduced to provide an approximately cosecant squared beam shape.

10. A displaced feed antenna according to claim 1 in which the reflecting boundaries are either continuous conducting walls between conducting plates or arrays of closely spaced electrically conducting vias or columns between the conducting plates where the said spaced conducting plates are made from any sufficiently conducting material, for example, thin metal sheets or deposited metal; and in which the linear or curved arrays of displaced feeds are in the form of reciprocal transitions between radio frequency transmission lines and spaced conducting plate.

11. A displaced feed antenna according to claim 1 in which the selection means to route radio frequency energy to and from individual and adjacent elements is either an active parallel plate solid state plasma commutating device or a multi-way radio frequency switch configuration or a radio frequency micro-electromechanical multi-way switch configuration.

12. A displaced feed antenna according to claim 1 and including a displaced feed parallel plate selection unit, which uses electronically or electromechanically controllable reflective surfaces, the displaced parallel plate selection unit being positioned directly between spaced conducting plates of the beamformer to provide a highly integrated launch into parallel plate, subsequent inter-plate step transitions and subsequent transitions into transmission lines; in which the first launch into the parallel plate is either through a single element fed by a single line or guide or an array of elements fed by an equal number of lines or guides to allow for further beamforming control on launch or monopulse operation; in which the controllable reflective surface is in the form of either a diagonal mirror embedded in a dielectric slab, which can be linearly displaced along the focal line or an open elliptical mirror embedded in a dielectric disk, which can be angularly displaced around a focal arc; in which both selection means are able to transit, using a step transition, from spaced conducting plates into patterned transmission lines to any required pattern of displaced feeds; and in which the selection means is mechanically supported by the next layer of parallel plate, which can take the form of a multi-layer radio frequency printed circuit board, with both radio frequency and DC control tracks for the selection of the displaced reflective surfaces.

13. A displaced feed antenna according to claim 1 and including an optical selection and combining network to allow the beamforming configuration to perform multi-beam scanning in two dimensions and in which multiple spaced conducting plates are configured in a stack and can be fed either corporately over the stack and where each adjacent displaced feed has an incremented time delay associated with it, achieved through a small displacement of the selecting reflecting surface or, alternatively through a further spaced conducting plate network, and which acts as an orthogonal beamforming network capable of illuminating the stack with appropriately delayed signals to cause orthogonal scanning of the beam.

14. A displaced feed antenna according to claim 1 in which multiple orthogonal beamforming networks are introduced to appropriate displaced feeds around a stack of beamformers to provide simultaneous multiple beam scanning in one dimension; in which useful beam distortion are implemented either by distorting internal and external reflectors or refractors or multiple displaced feeds are phase and amplitude weighted to provide the same effect; and in which low noise amplifiers and power amplifiers are introduced into transmission lines feeding array elements to compensate for line losses and distribute power devices to so improve sensitivity and increase power transmitted respectively.

* * * * *